US010834787B2

(12) United States Patent
Jung et al.

(10) Patent No.: US 10,834,787 B2
(45) Date of Patent: Nov. 10, 2020

(54) INDUCTION HEATING COOKING DEVICE

(71) Applicant: SAMSUNG ELECTRONICS CO., LTD., Suwon-si (KR)

(72) Inventors: Gwang Jin Jung, Suwon-si (KR); Jung Kwon Kim, Seoul (KR); Ji Hyeoung Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 532 days.

(21) Appl. No.: 15/315,196

(22) PCT Filed: May 20, 2015

(86) PCT No.: PCT/KR2015/005038
§ 371 (c)(1),
(2) Date: Nov. 30, 2016

(87) PCT Pub. No.: WO2015/182914
PCT Pub. Date: Dec. 3, 2015

(65) Prior Publication Data

US 2017/0196048 A1 Jul. 6, 2017

(30) Foreign Application Priority Data

May 30, 2014 (KR) ..... 10-2014-0066320

(51) Int. Cl.
*H05B 6/12* (2006.01)
*F24C 15/10* (2006.01)
*H05B 6/02* (2006.01)

(52) U.S. Cl.
CPC ..... *H05B 6/1218* (2013.01); *F24C 15/10* (2013.01); *H05B 6/1236* (2013.01);
(Continued)

(58) Field of Classification Search
CPC ..... F24C 15/10; F24C 7/04; H05B 2206/022; H05B 6/02; H05B 6/1218; H05B 6/1236; H05B 6/1245; H05B 6/123
(Continued)

(56) References Cited

U.S. PATENT DOCUMENTS

2003/0111460 A1 6/2003 Boegel et al.
2007/0170169 A1 7/2007 Jeong
(Continued)

FOREIGN PATENT DOCUMENTS

CN 101627659 1/2010
DE 20 2012 003 287 U1 8/2013
(Continued)

OTHER PUBLICATIONS

Japanese to English Translation of JP 2009176471, Published in Year 2009.*
(Continued)

*Primary Examiner* — Michael G Hoang
(74) *Attorney, Agent, or Firm* — Staas & Halsey LLP

(57) ABSTRACT

An induction heating cooking device includes a cooking table having an auxiliary slit through which light passes; an induction coil for generating a magnetic field so as to inductively heat a cooking container placed on the cooking table; at least one light source disposed at the outer edge of the induction coil; an optical member for changing the traveling direction of light emitted the light source and concentrating the light, and a main slit through which light emitted from the optical member passes so as to form a flame image on the cooking container. The induction heating cooking device forms a virtual flame image on the lower surface of a cooking container at the time of operation of the induction coil, thereby enabling the heating state of the cooking container to be easily recognized.

25 Claims, 37 Drawing Sheets

(52) U.S. Cl.
CPC ..... *H05B 6/1245* (2013.01); *H05B 6/02* (2013.01); *H05B 2206/022* (2013.01)

(58) Field of Classification Search
USPC ..... 219/620
See application file for complete search history.

(56) References Cited

U.S. PATENT DOCUMENTS

| | | | | |
|---|---|---|---|---|
| 2008/0099449 | A1 | 5/2008 | England et al. | |
| 2011/0000904 | A1 | 1/2011 | Sakakibara et al. | |
| 2011/0037084 | A1* | 2/2011 | Sekii | F21V 5/04 257/89 |
| 2013/0220298 | A1 | 8/2013 | Motabar et al. | |
| 2015/0013660 | A1* | 1/2015 | Holzinger | H05B 6/1209 126/213 |

FOREIGN PATENT DOCUMENTS

| | | | | |
|---|---|---|---|---|
| JP | 2003-197357 | | 7/2003 | |
| JP | 2003-272815 | | 9/2003 | |
| JP | 2003257601 | A * | 9/2003 | H05B 6/12 |
| JP | 2009-176471 | | 8/2009 | |
| JP | 2010-182526 | | 8/2010 | |
| JP | 2011-95327 | | 5/2011 | |
| JP | 2011-96493 | | 5/2011 | |
| JP | 2011-165651 | | 8/2011 | |
| JP | 2012-190573 | A | 10/2012 | |
| WO | 2012/137517 | | 10/2012 | |
| WO | 2013/149792 | | 10/2013 | |
| WO | WO 2015/182914 | A1 | 12/2015 | |

OTHER PUBLICATIONS

Japanese to English Translation of JP 2003272815, Published in Year 2003.*
Japanese to English machine translation of JP 2003257601; Published in 2003.*
Japanese Office Action dated May 7, 2019 in Japanese Patent Application No. 2017-515644.
Chinese Office Action dated Jul. 31, 2018 in Chinese Patent Application No. 201580039644.4.
Extended European Search Report dated Dec. 20, 2017 in corresponding European Patent Application No. 15798846.0.
European Communication pursuant to Rules 161(2) and 162 EPC dated Jan. 17, 2017 in corresponding European Patent Application No. 15798846.0.
Canadian Notice of Allowance dated Sep. 29, 2017 in corresponding Canadian Patent Application No. 2,950,861.
International Search Report; (Form PCT/ISA/210); dated Aug. 28, 2015 in corresponding International Patent Application No. PCT/KR2015/005038 (3 pages) (2 pages English Translation).
Written Opinion; (Form PCT/ISA/237); dated Aug. 28, 2015 in corresponding International Patent Application No. PCT/KR2015/005038 (6 pages).
Indian Office Action dated Jul. 3, 2019 from Indian Patent Application No. 201627040839, 8 pages.
European Office Action dated Jul. 17, 2019 from European Patent Application No. 15798846.0, 6 pages.
Chinese Office Action dated Oct. 23, 2019 in corresponding Chinese Patent Application No. 201580039644.4.
Korean Office Action dated Apr. 6, 2020 from Korean Application No. 10-2014-0066320, 10 pages.
Chinese Office Action dated May 19, 2020 from Chinese Application No. 201580039644.4, 7 pages.

* cited by examiner

[Fig. 1]
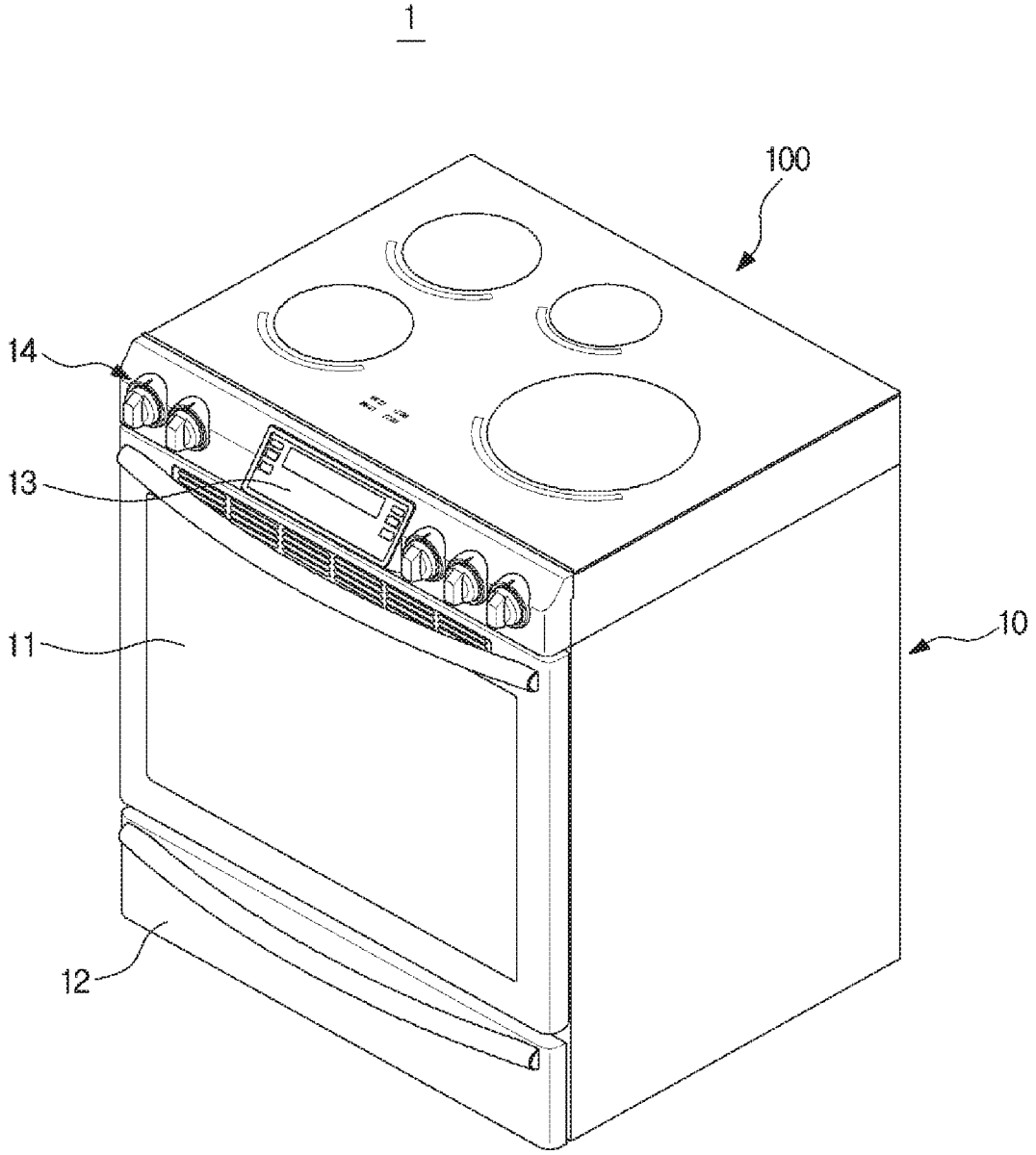

[Fig. 2]
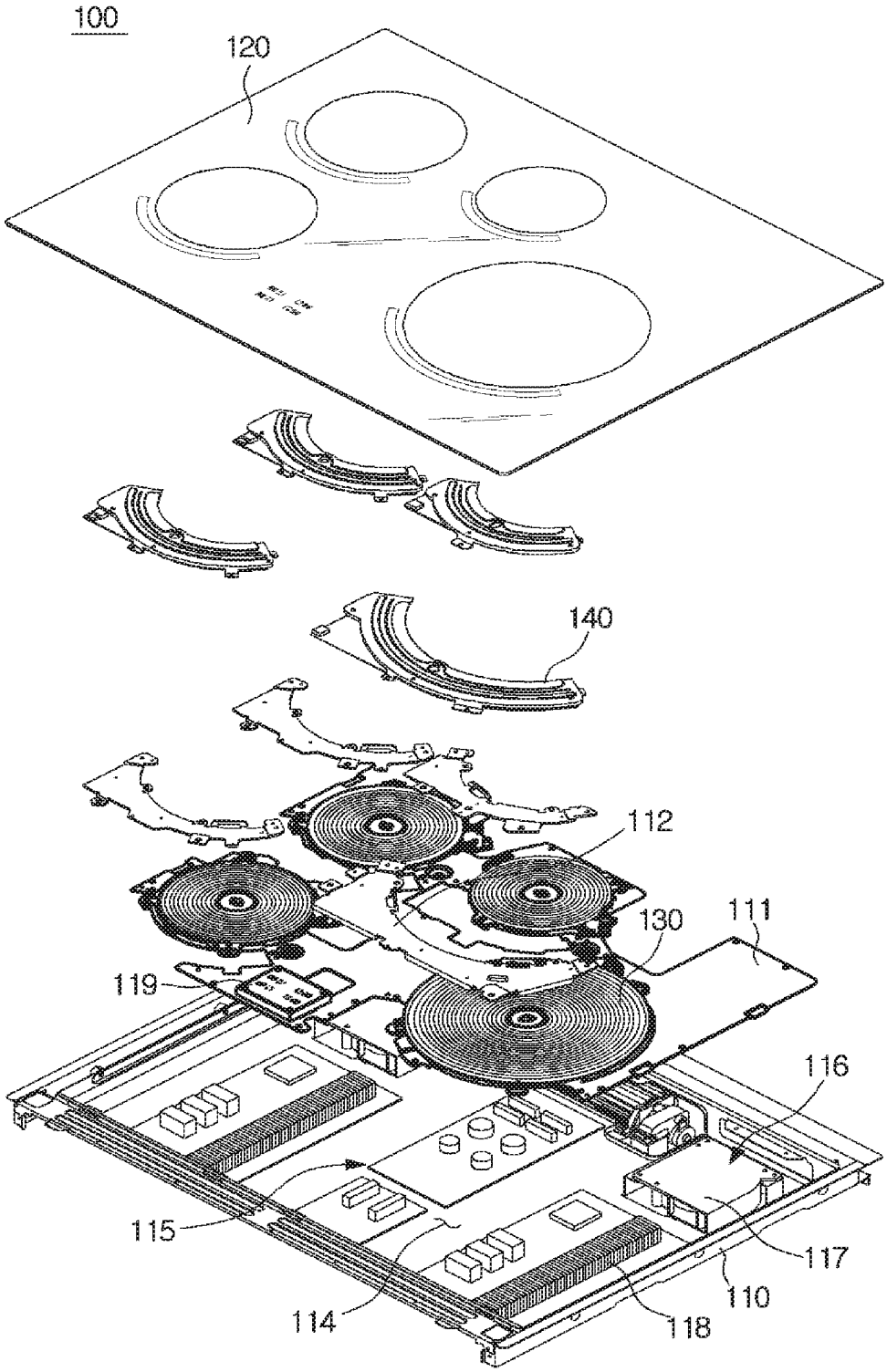

[Fig. 3]
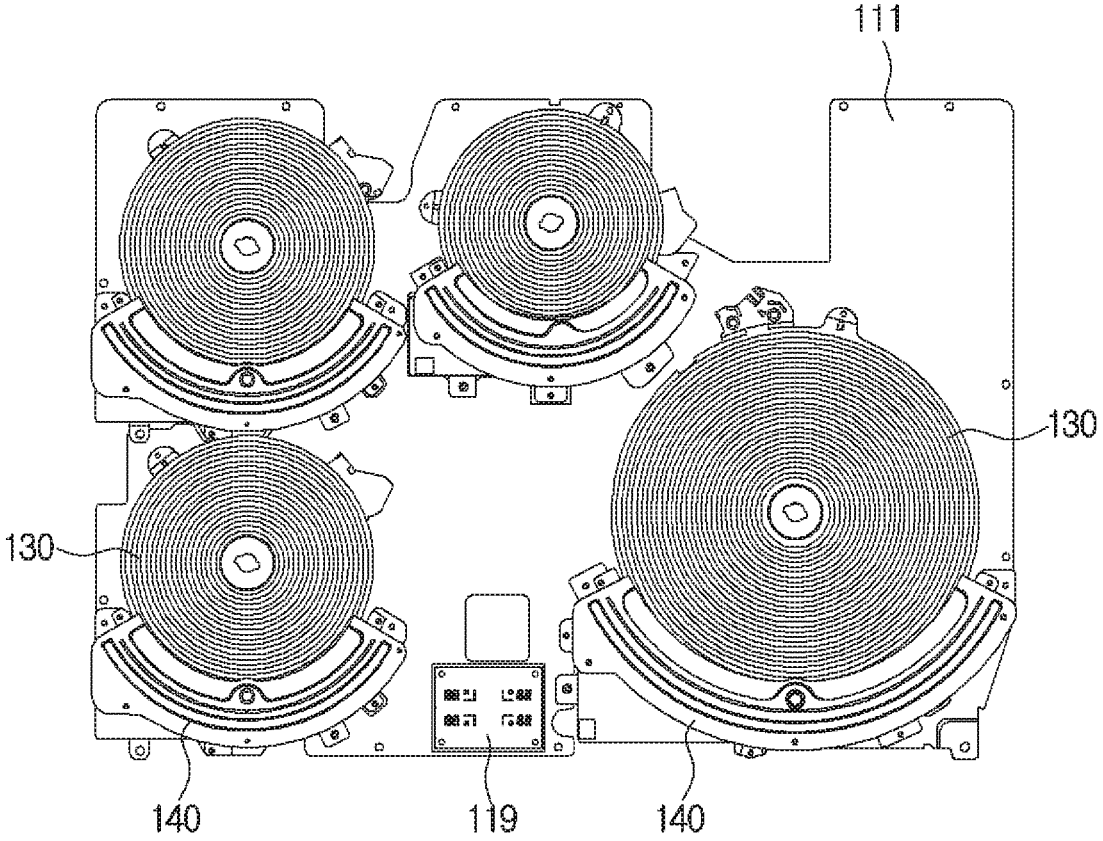

[Fig. 4]
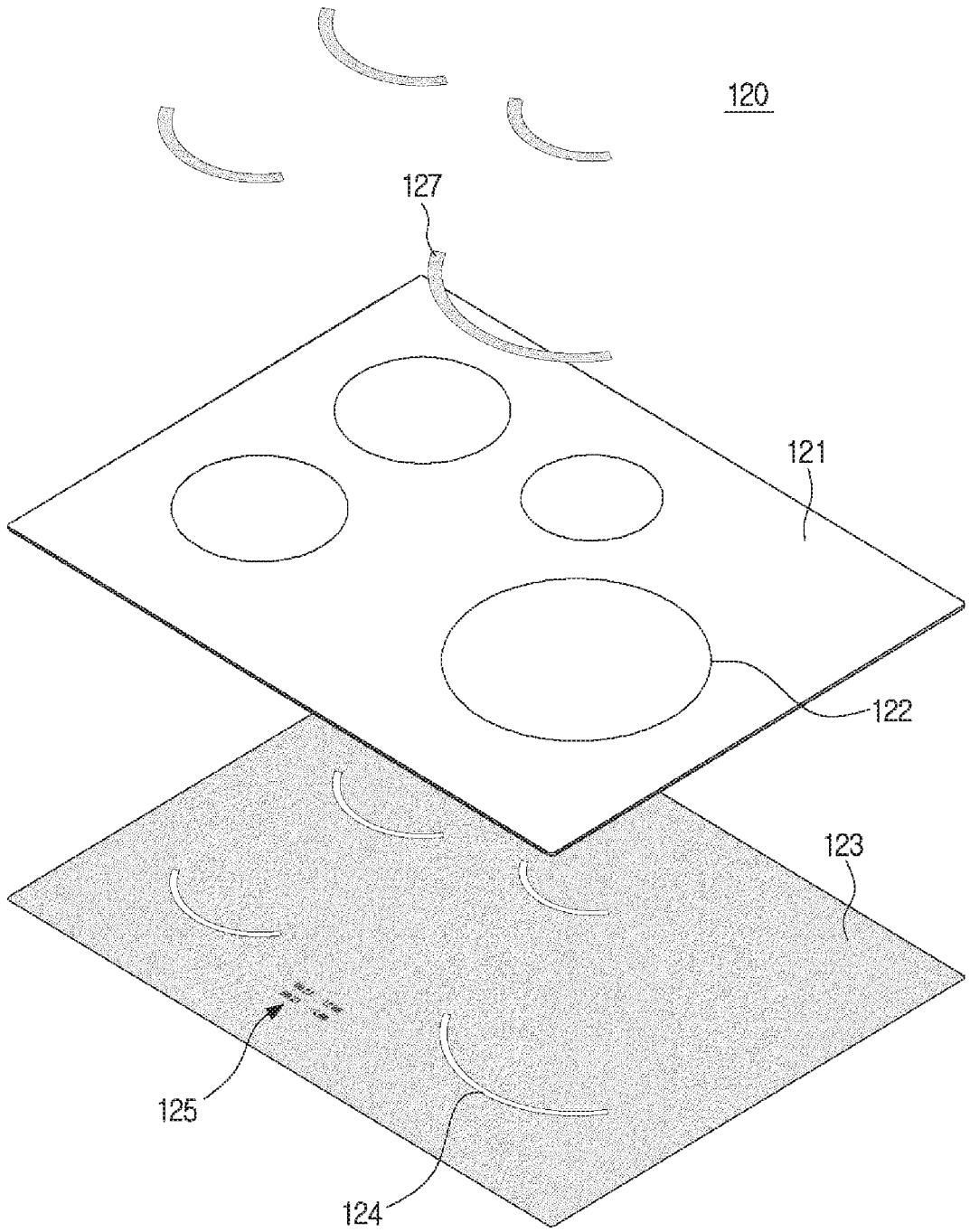

[Fig. 5]
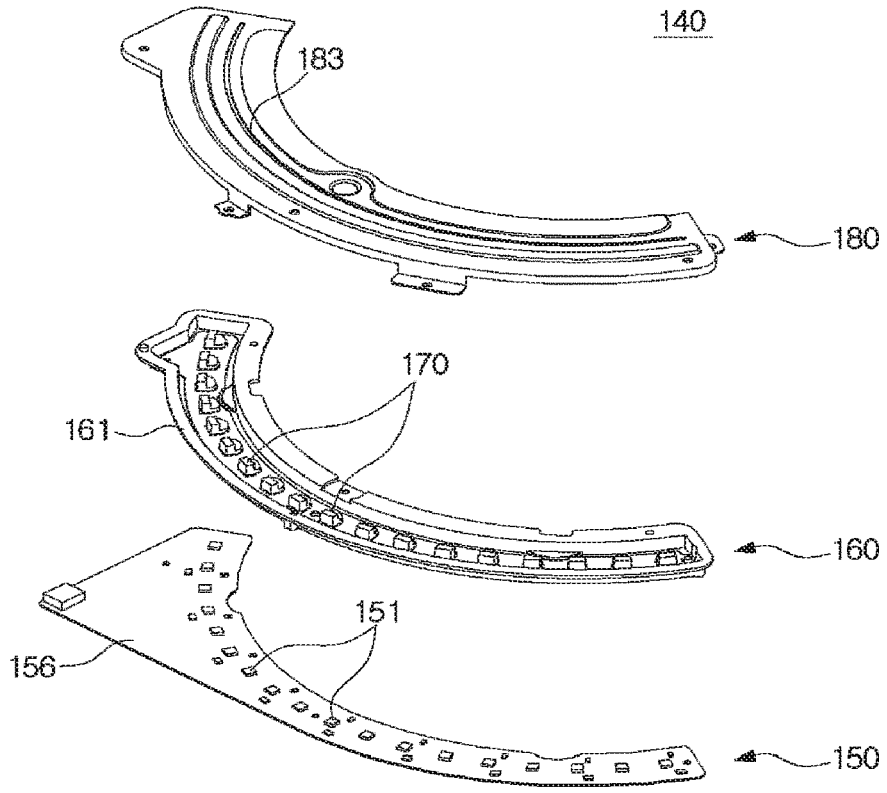
[Fig. 6]
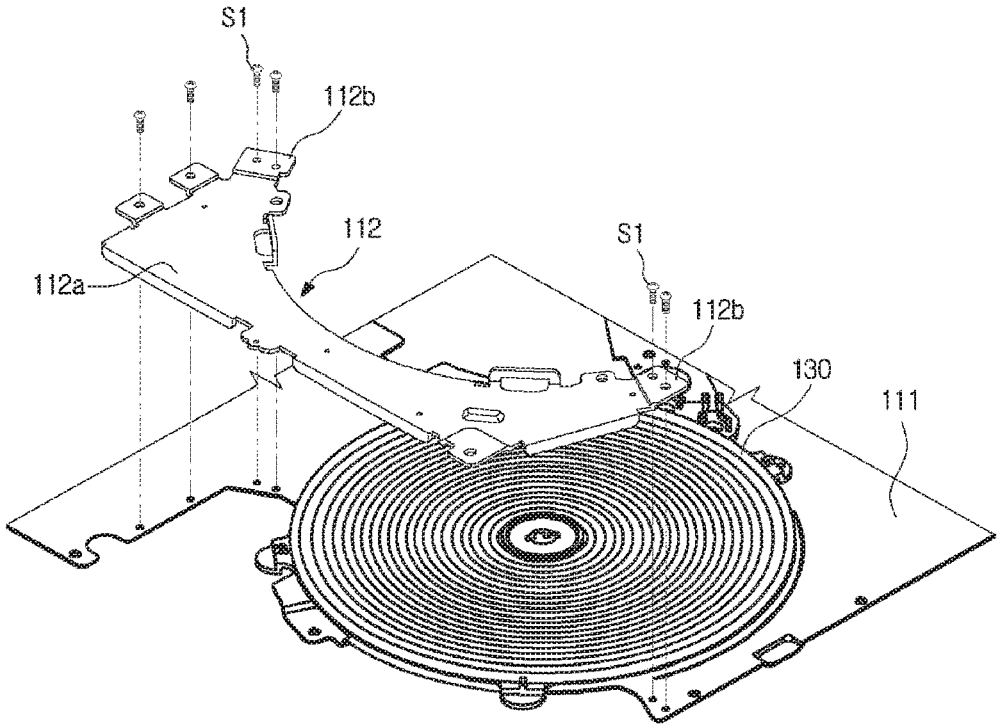

[Fig. 7]
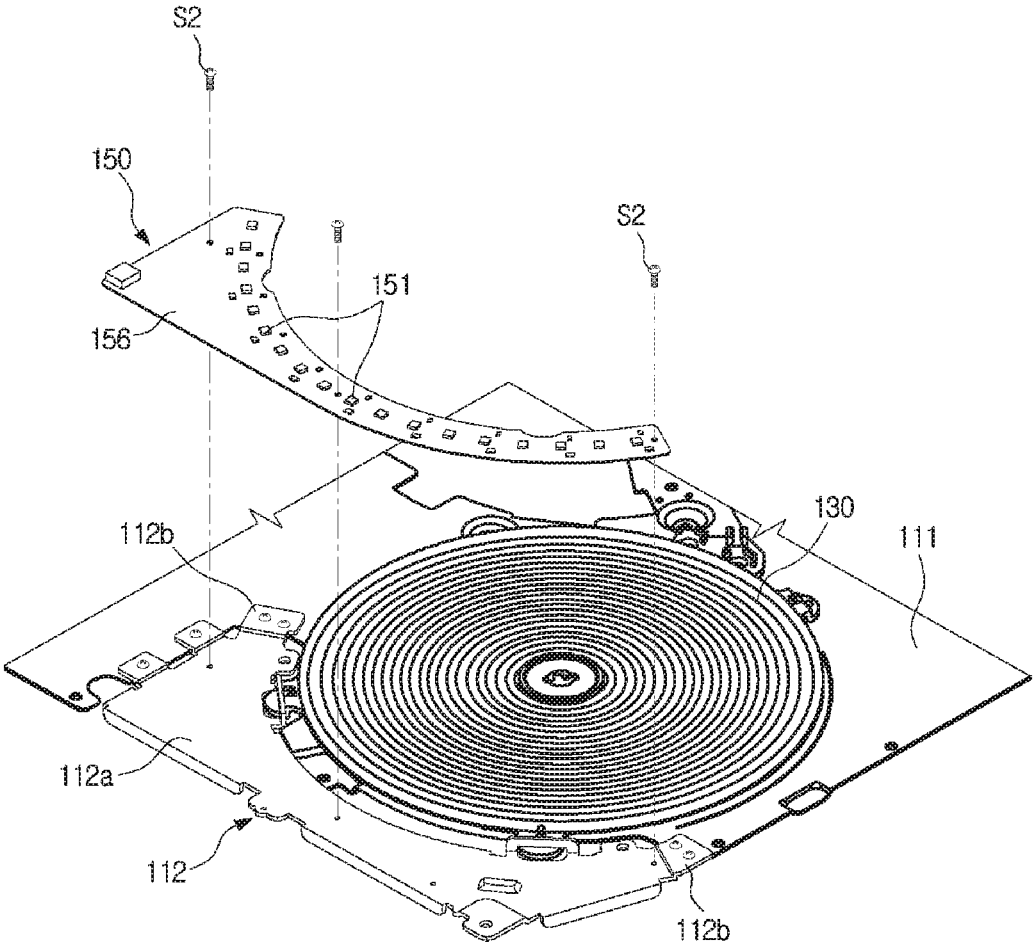

[Fig. 8]
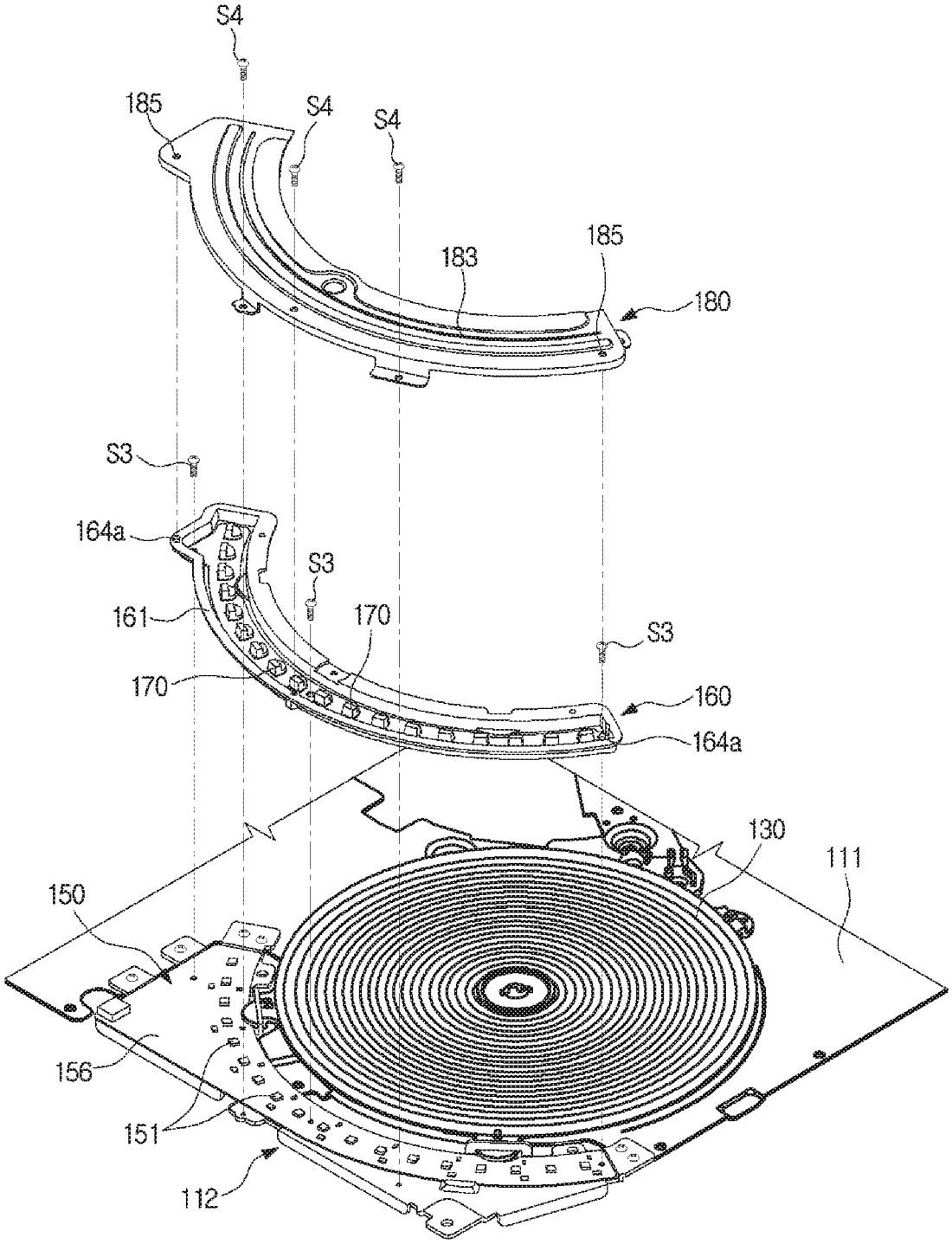

[Fig. 9]
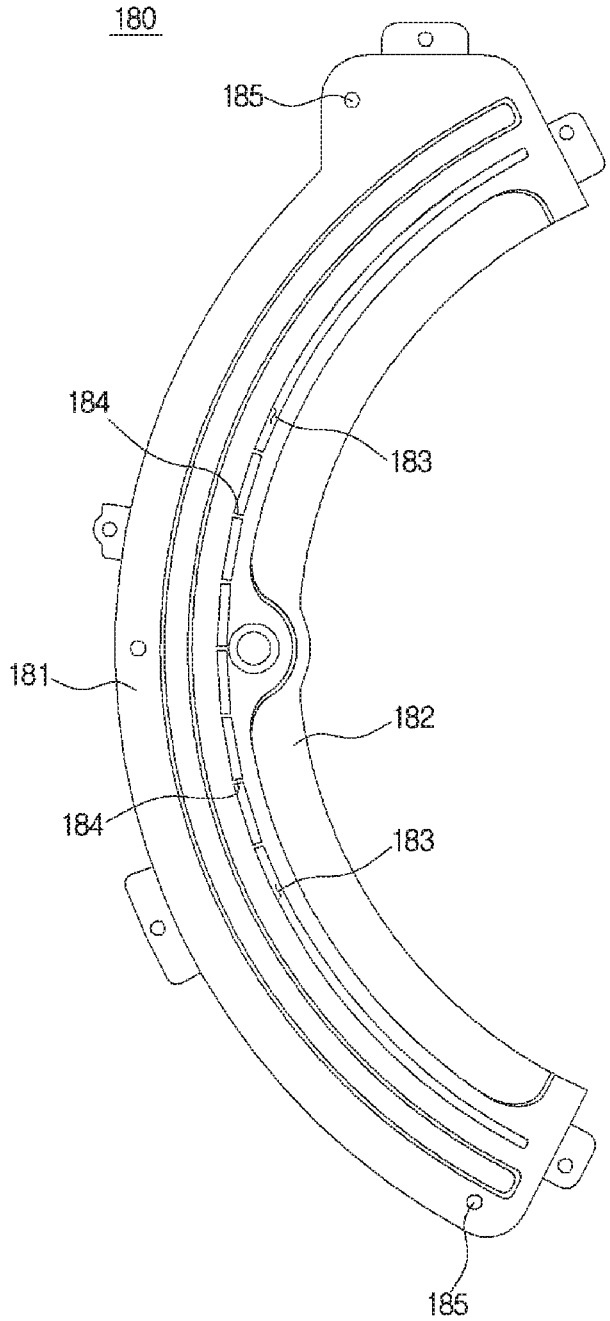

[Fig. 10]
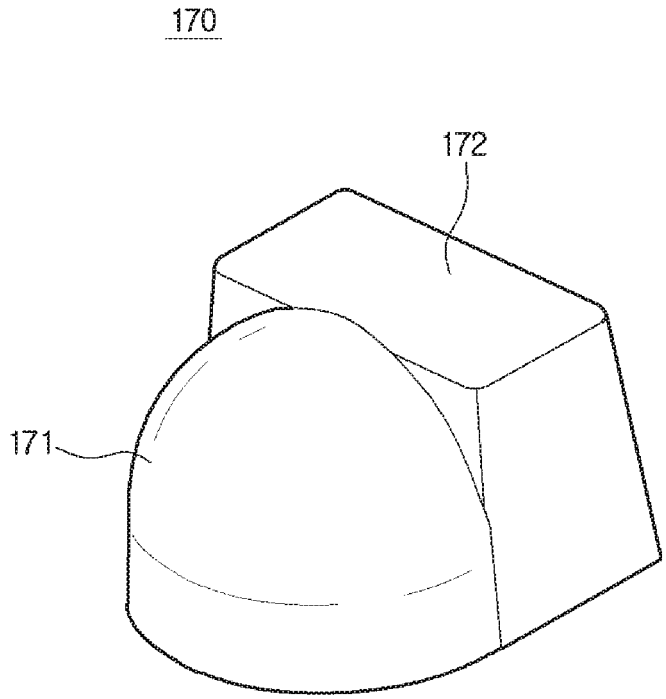

[Fig. 11]
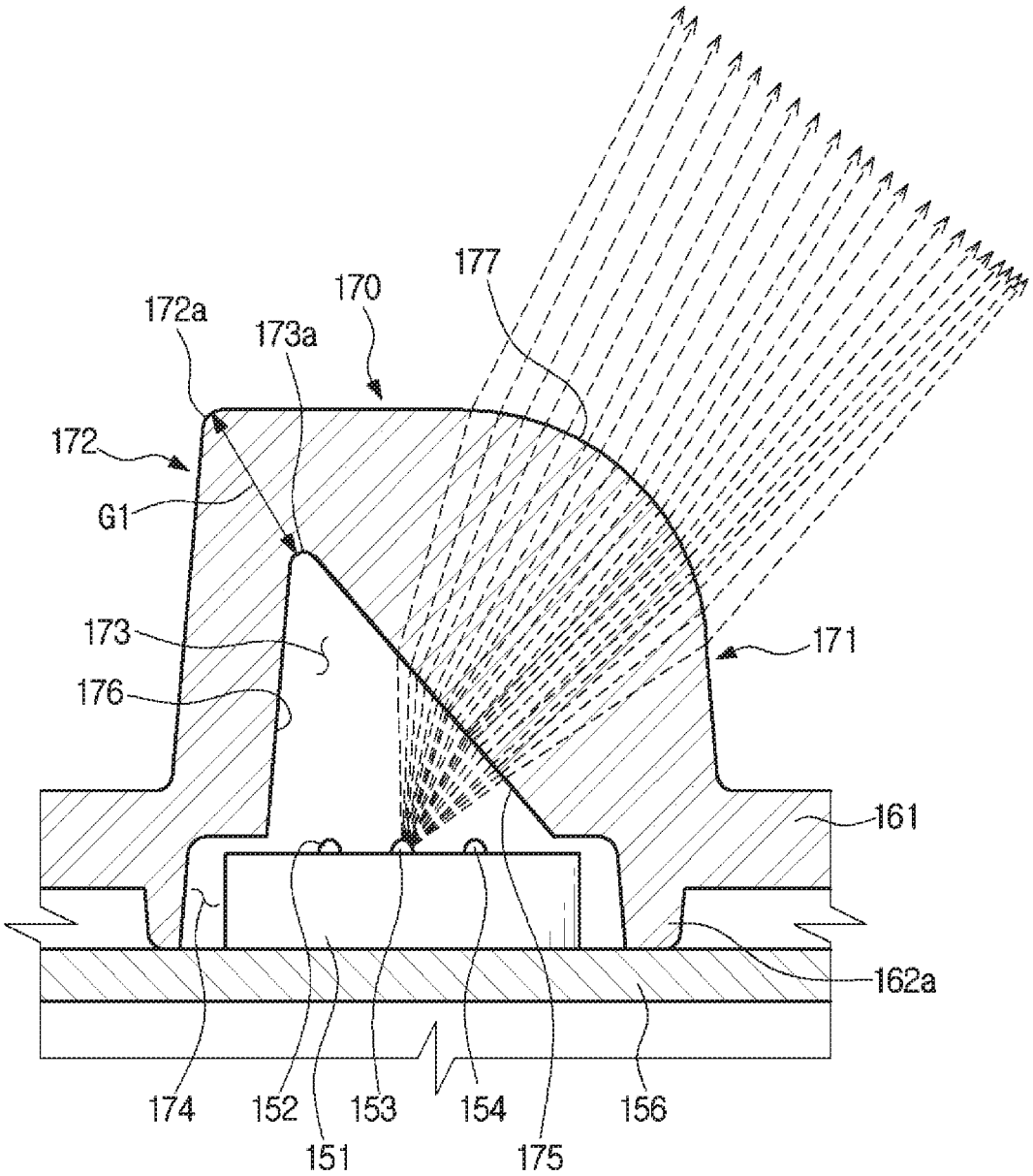

[Fig. 12]
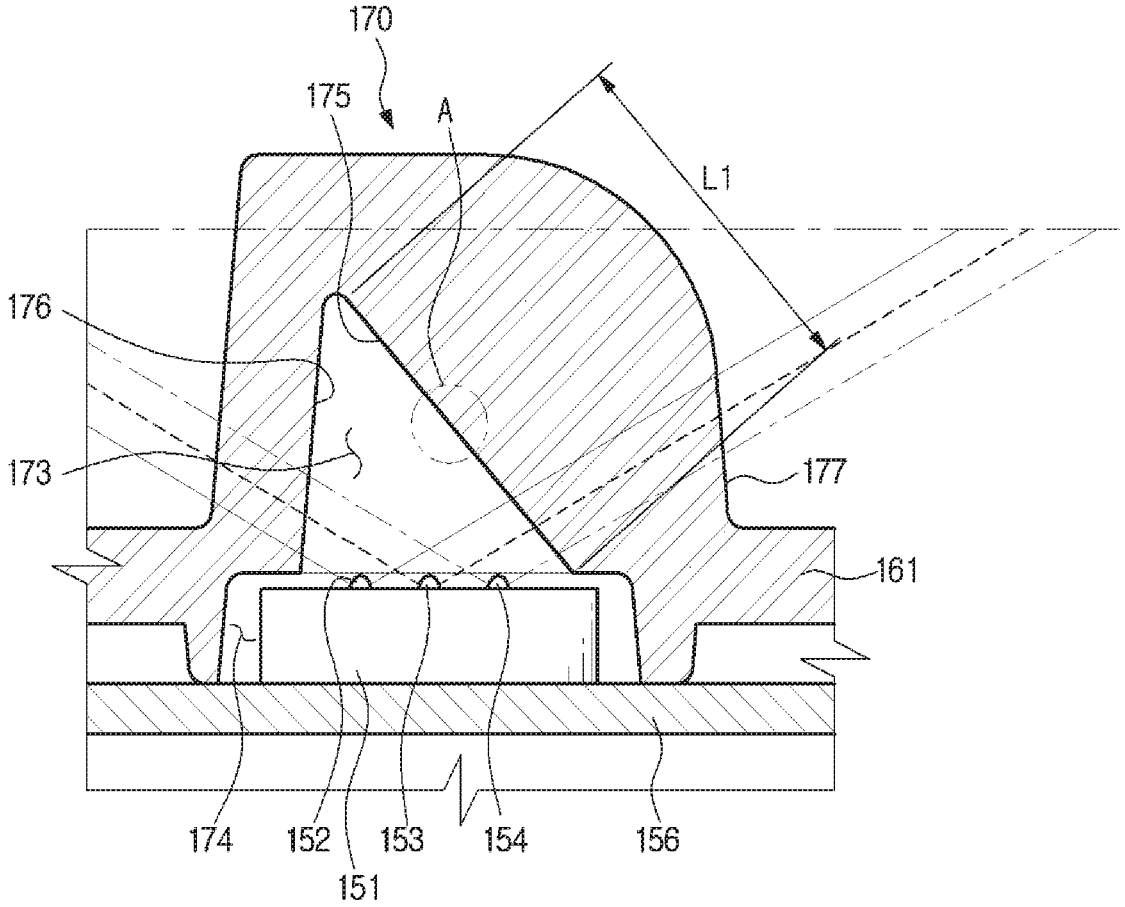

[Fig. 13]
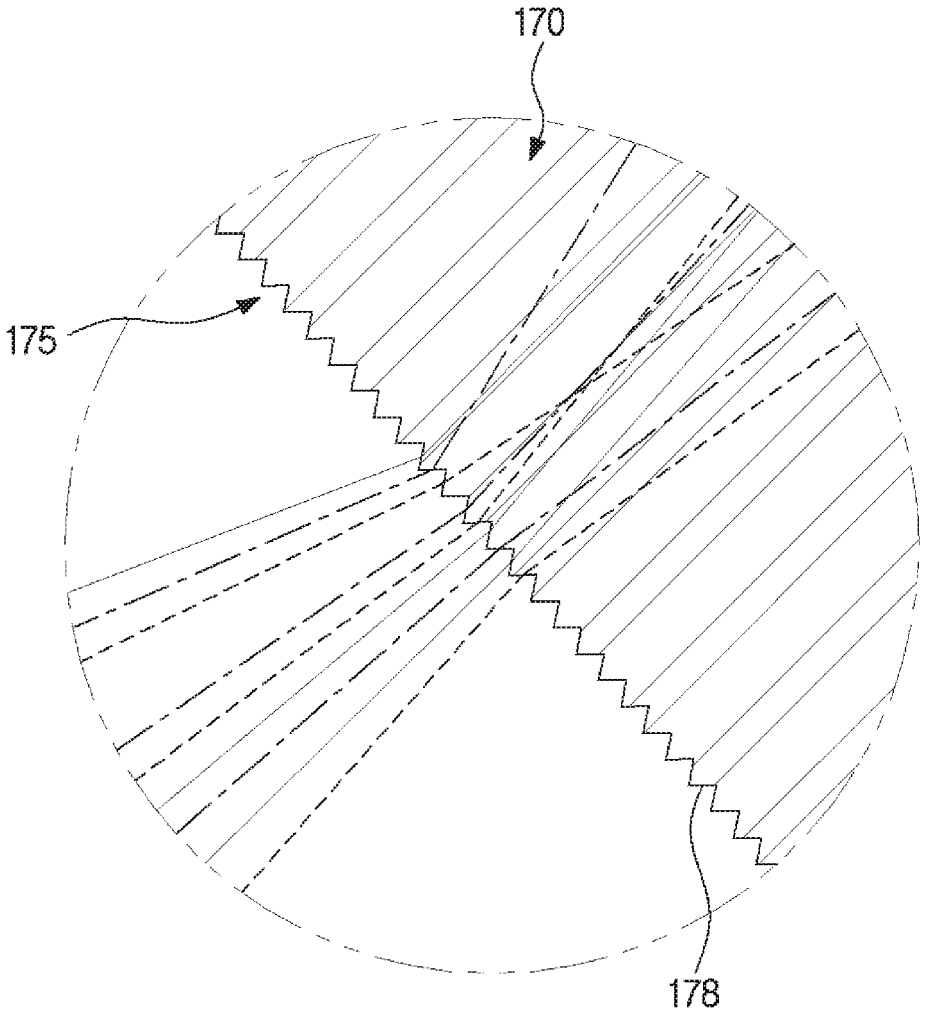

[Fig. 14]
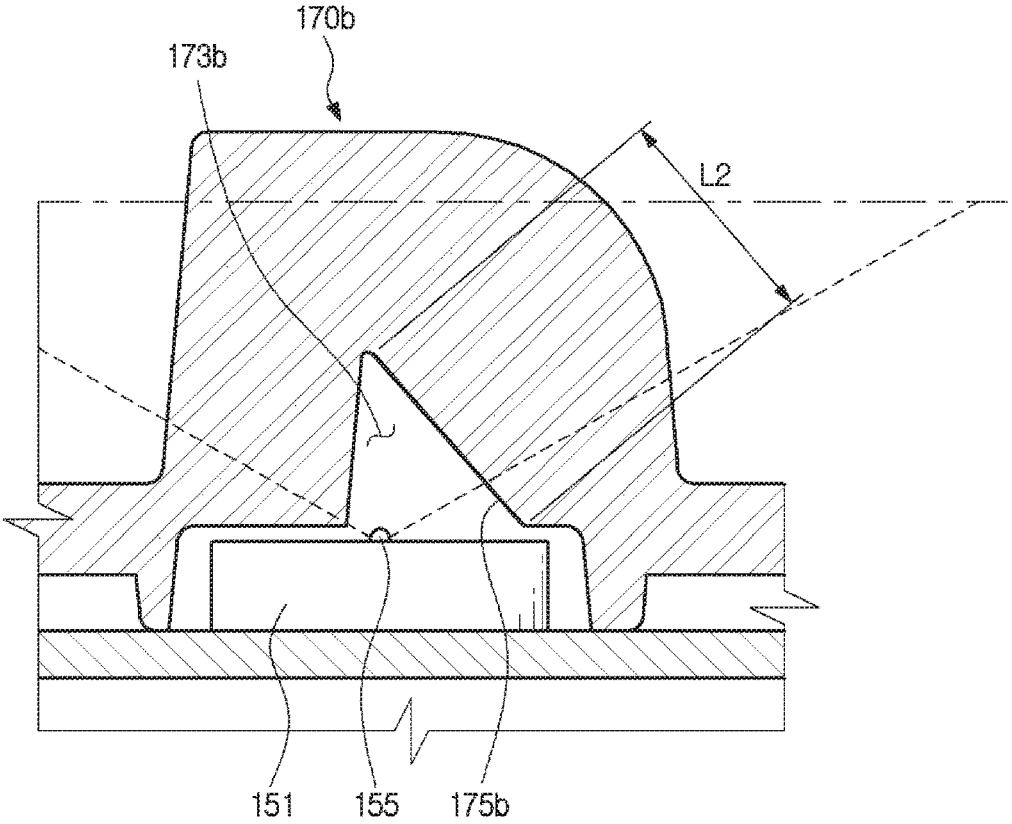
[Fig. 15]
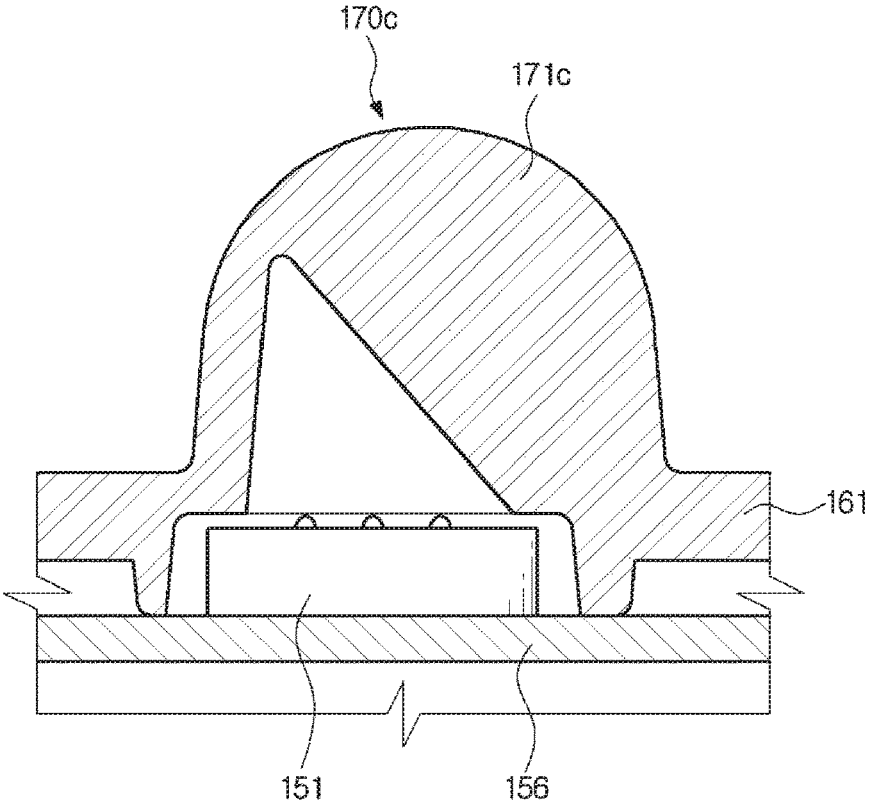

[Fig. 16]
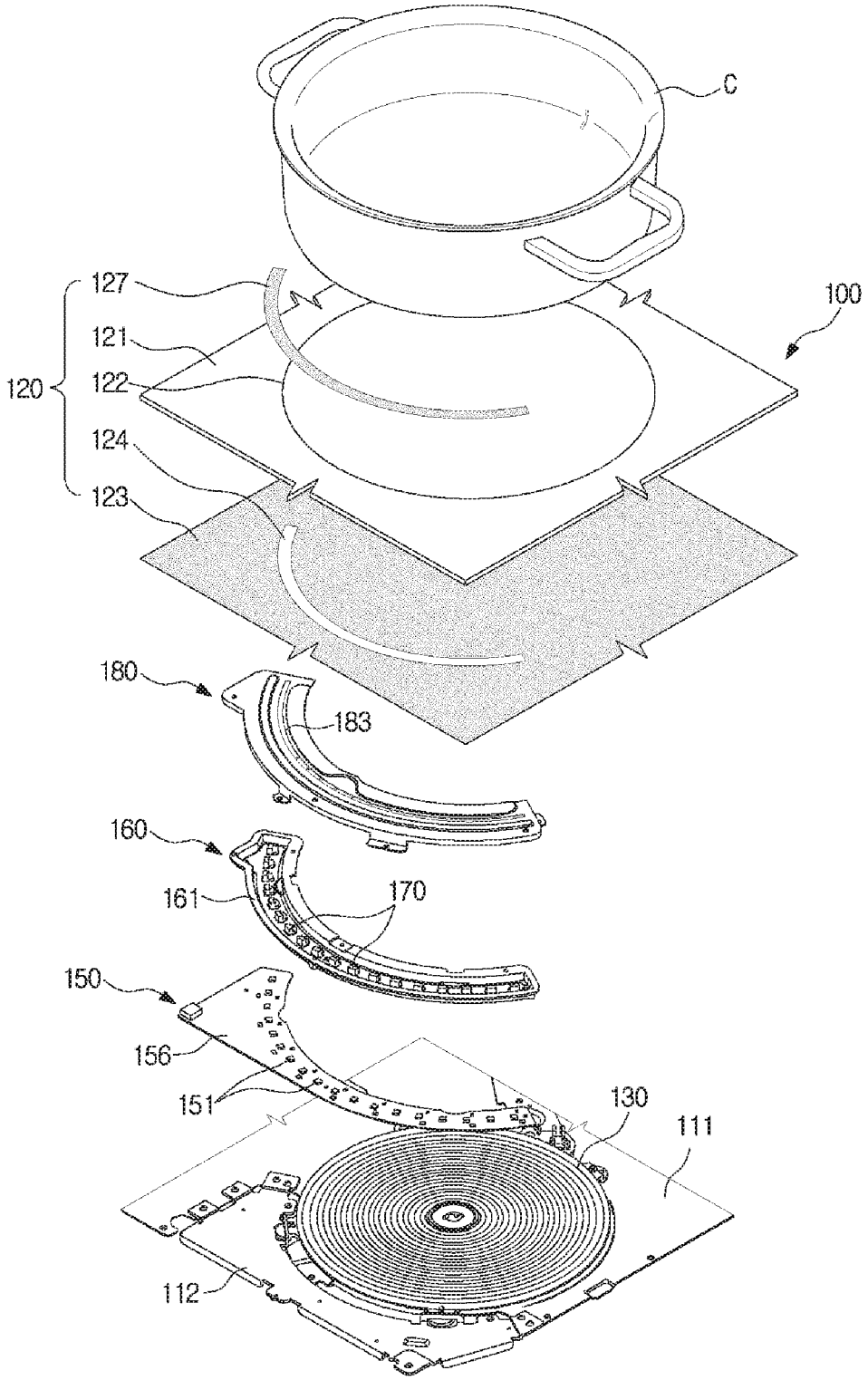

[Fig. 17]
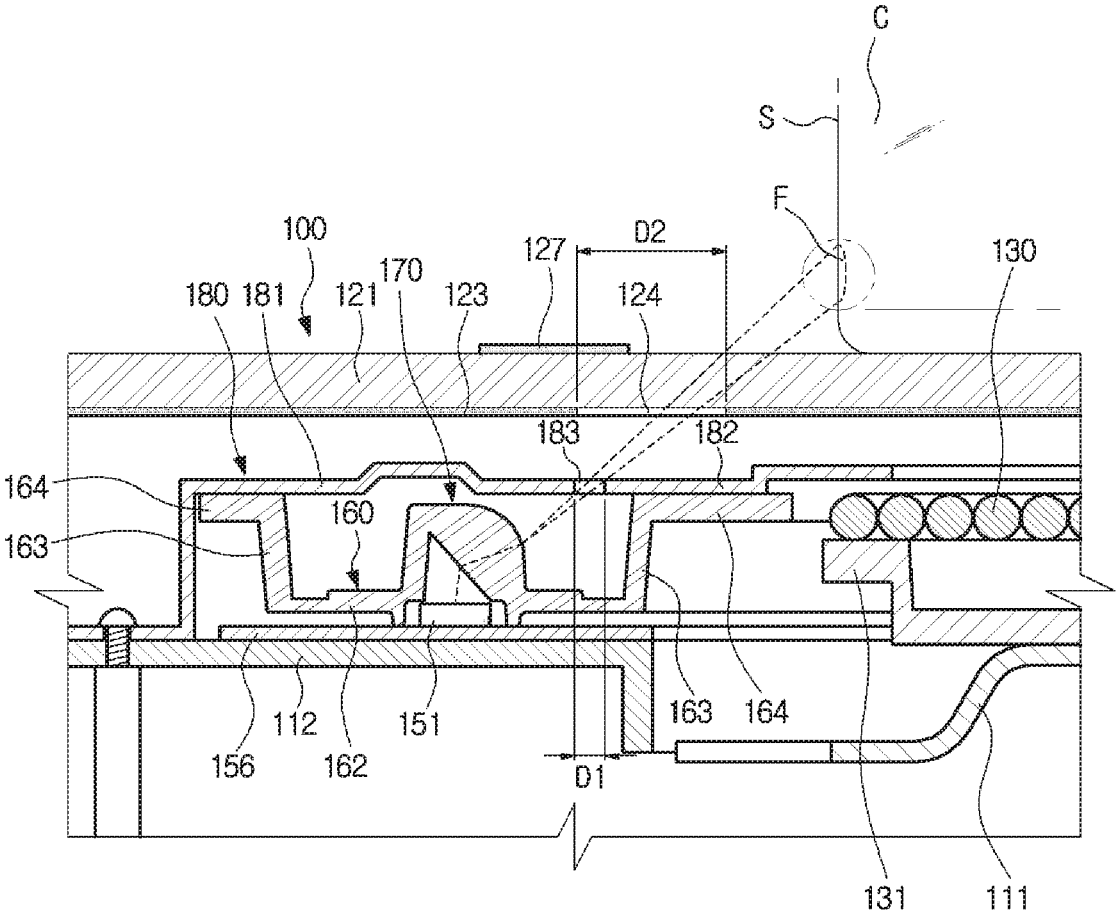

[Fig. 18]
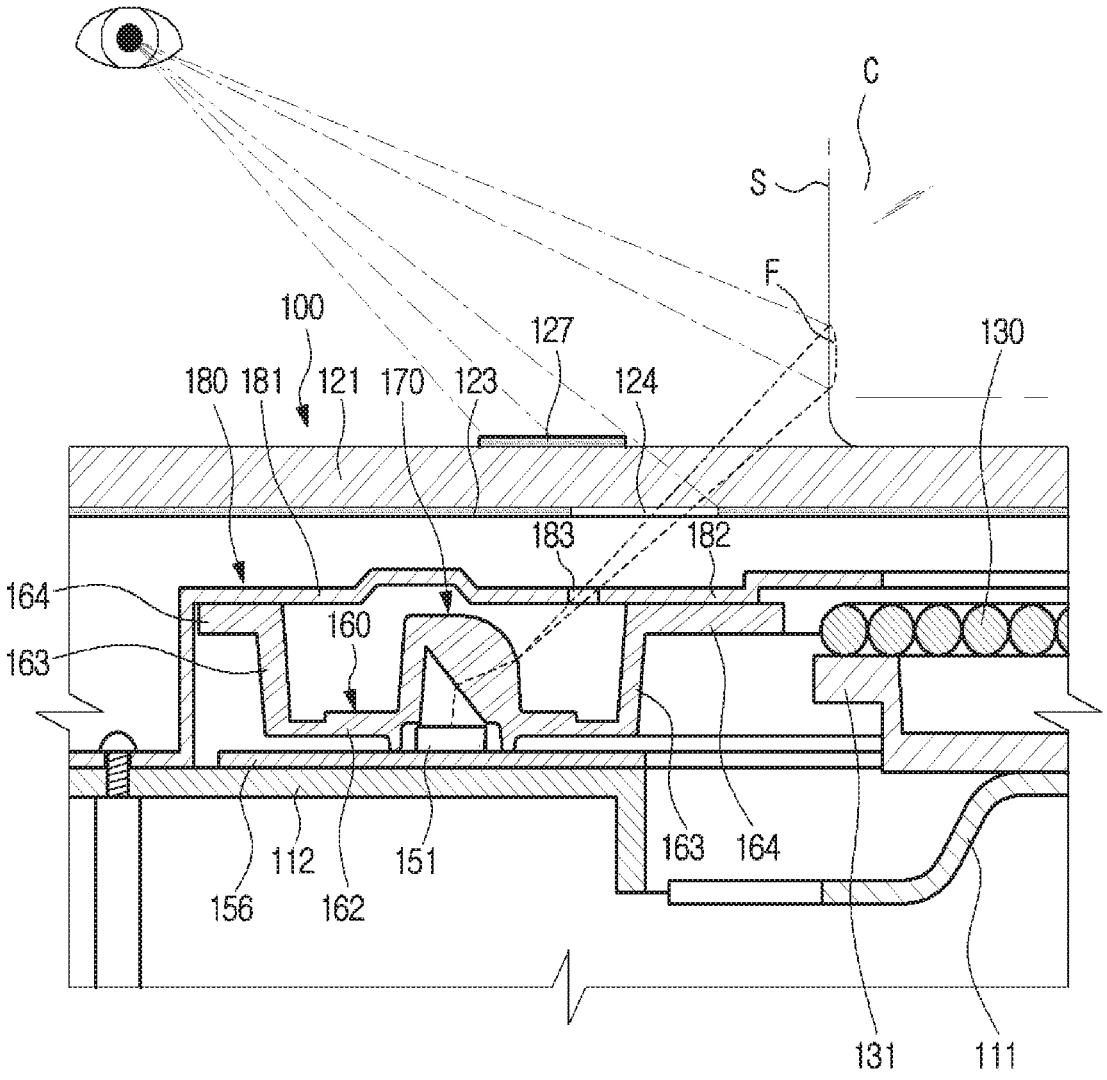

[Fig. 19]
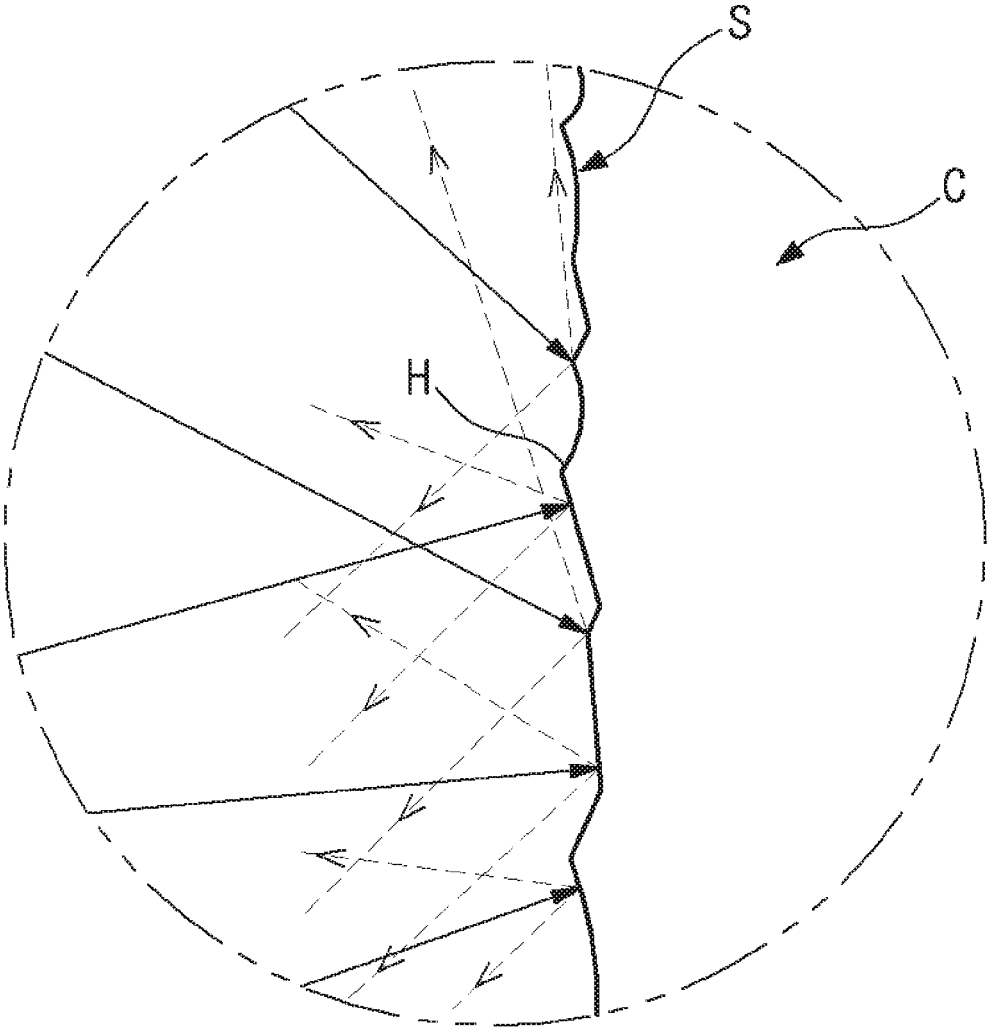

[Fig. 20]
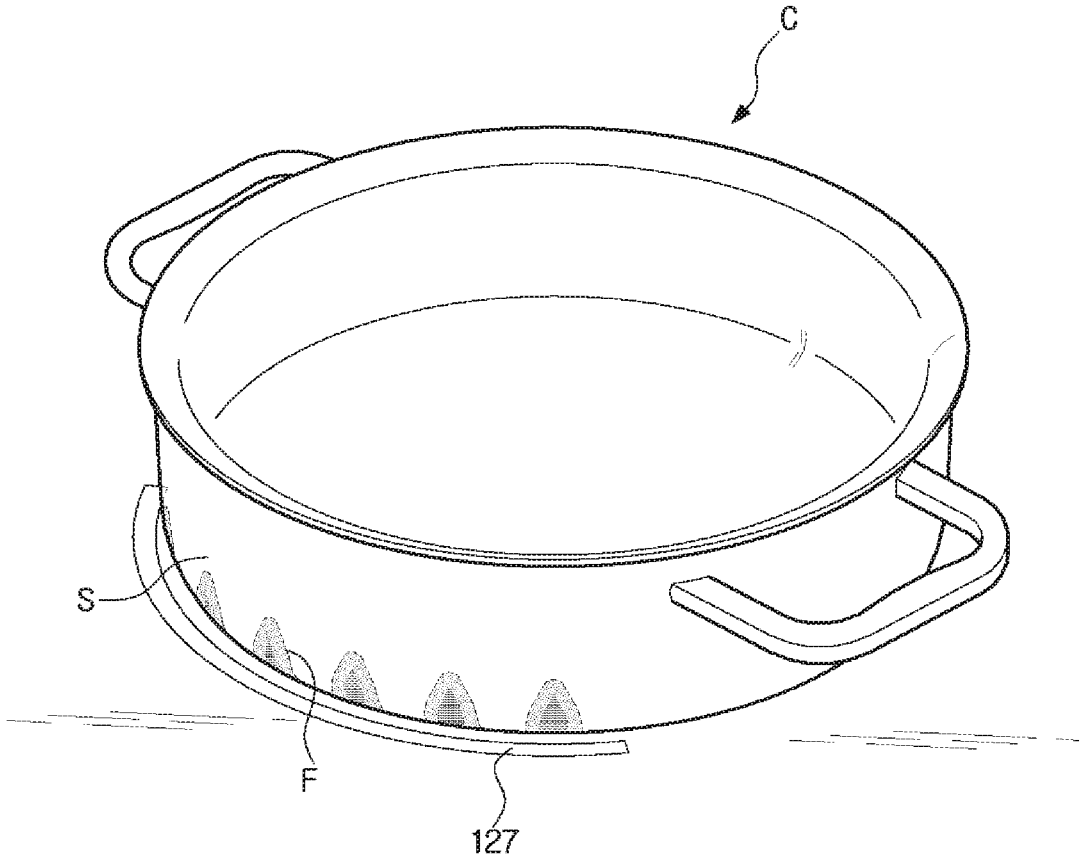

[Fig. 21]
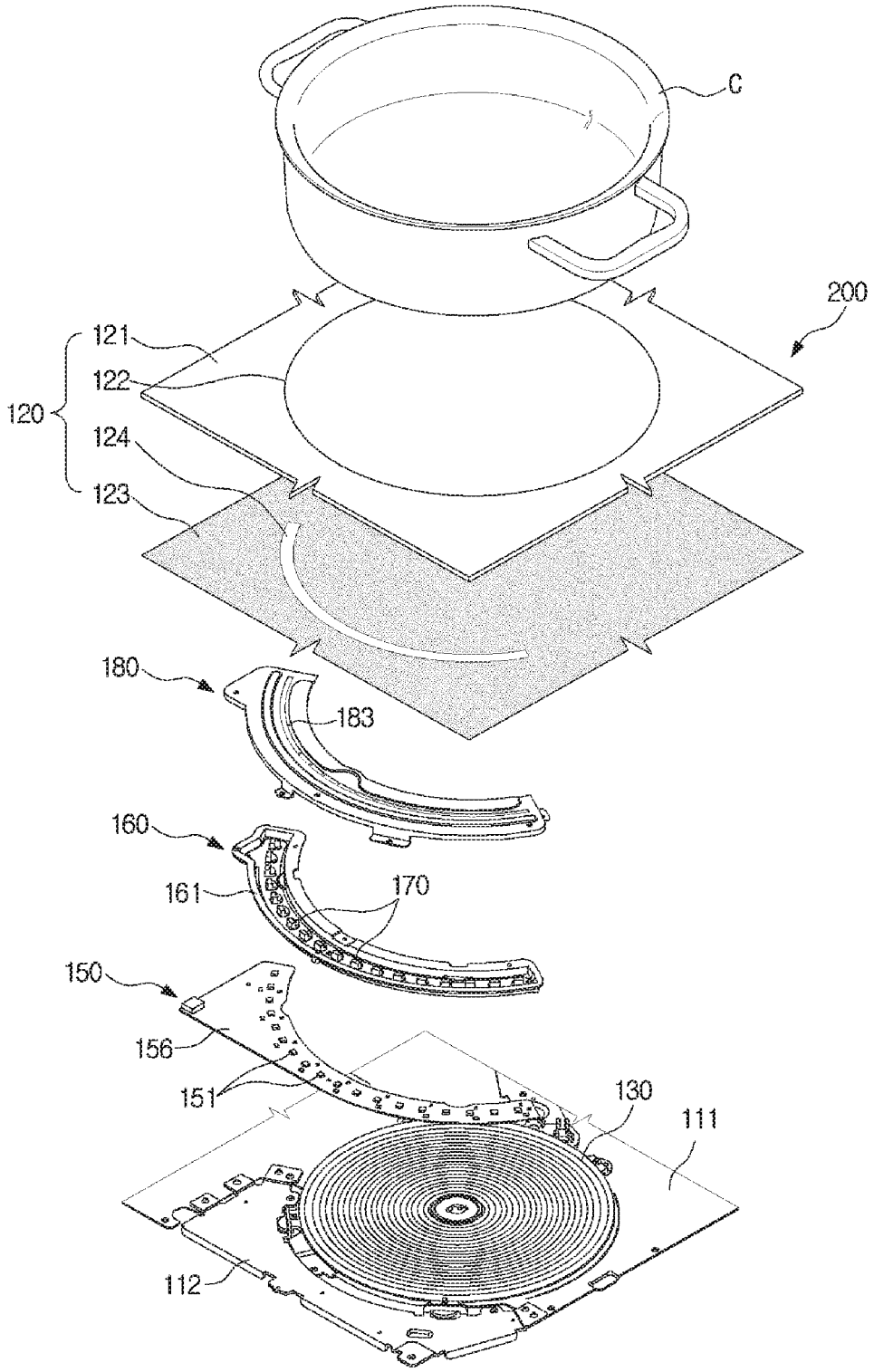

[Fig. 22]
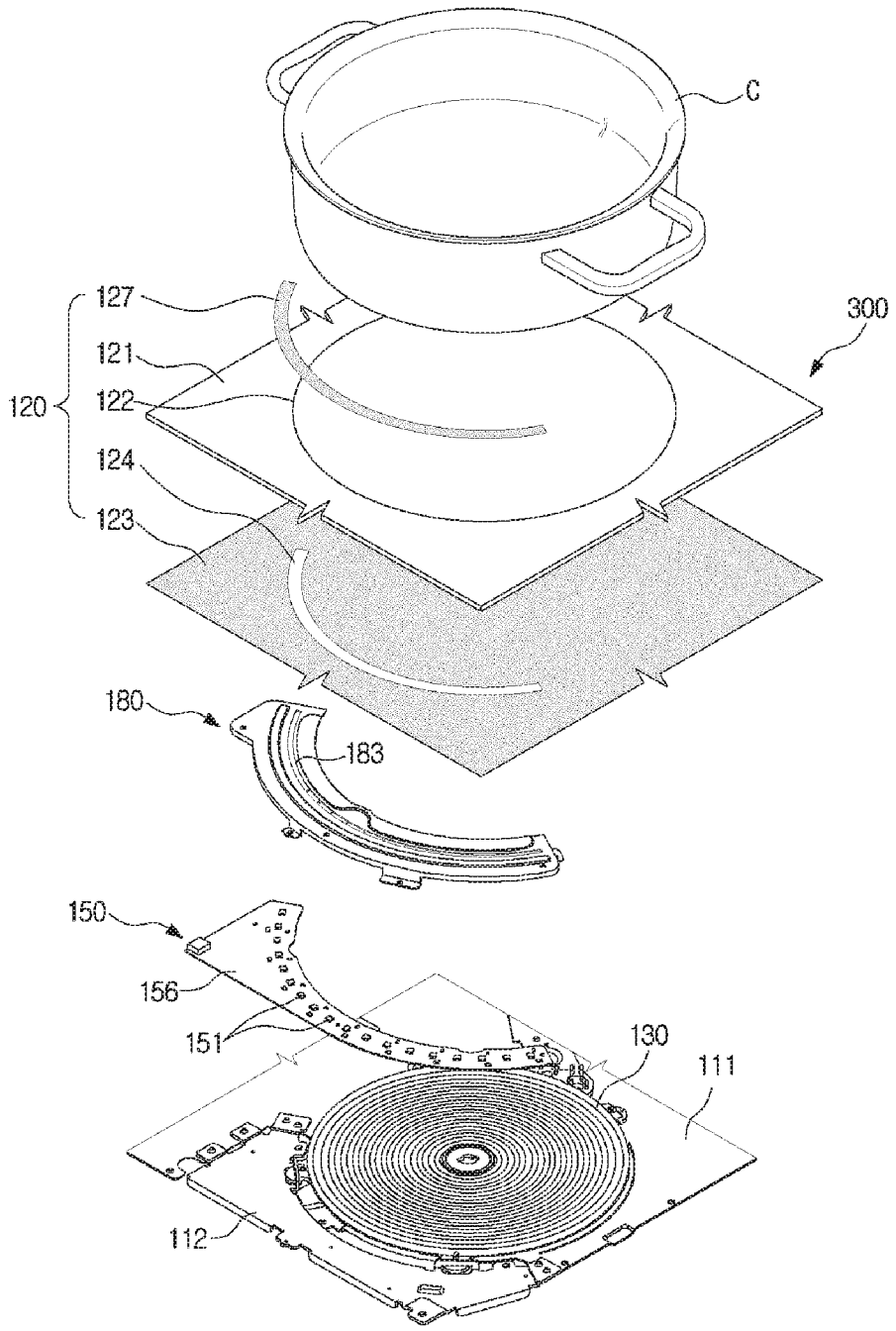

[Fig. 23]
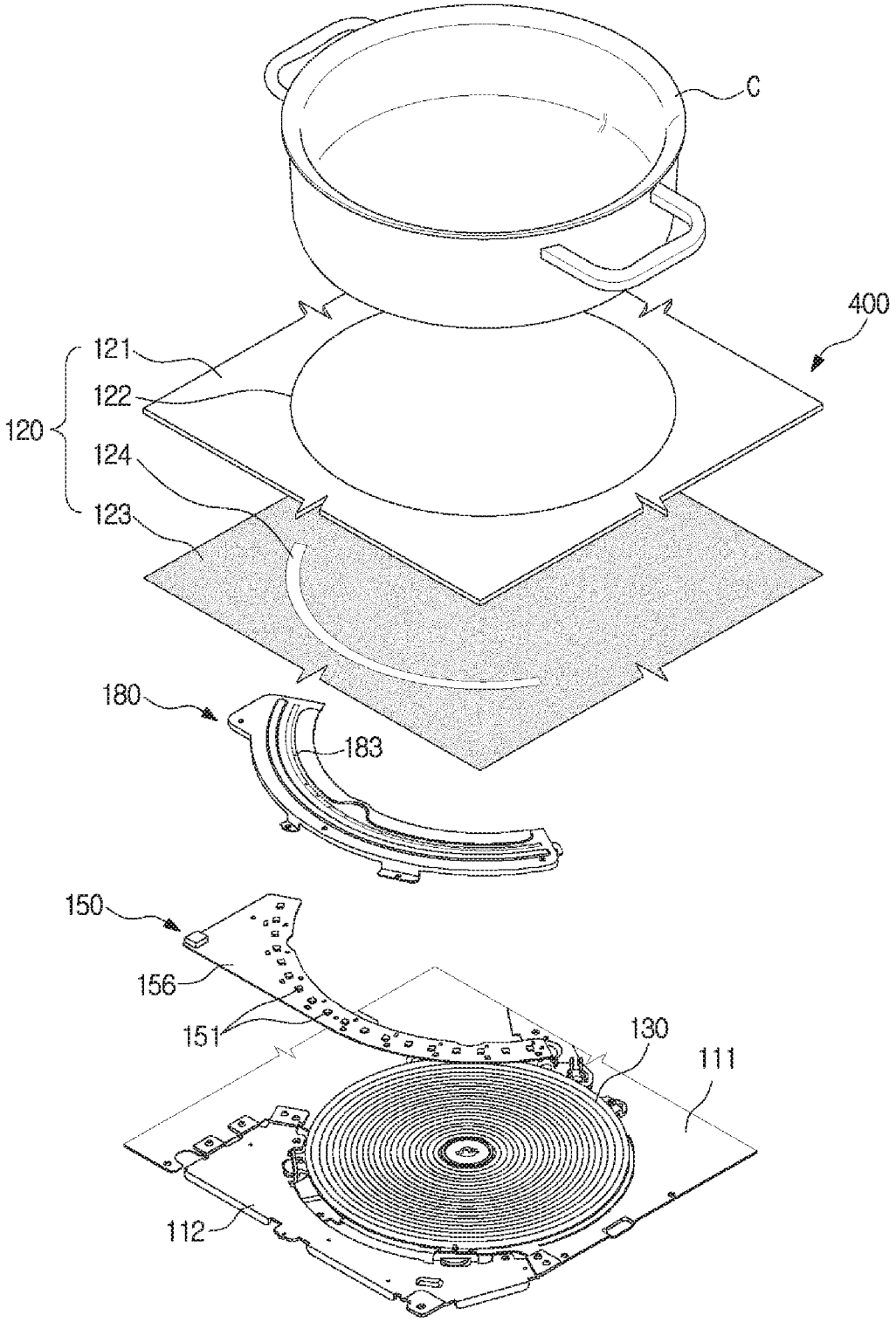

[Fig. 24]
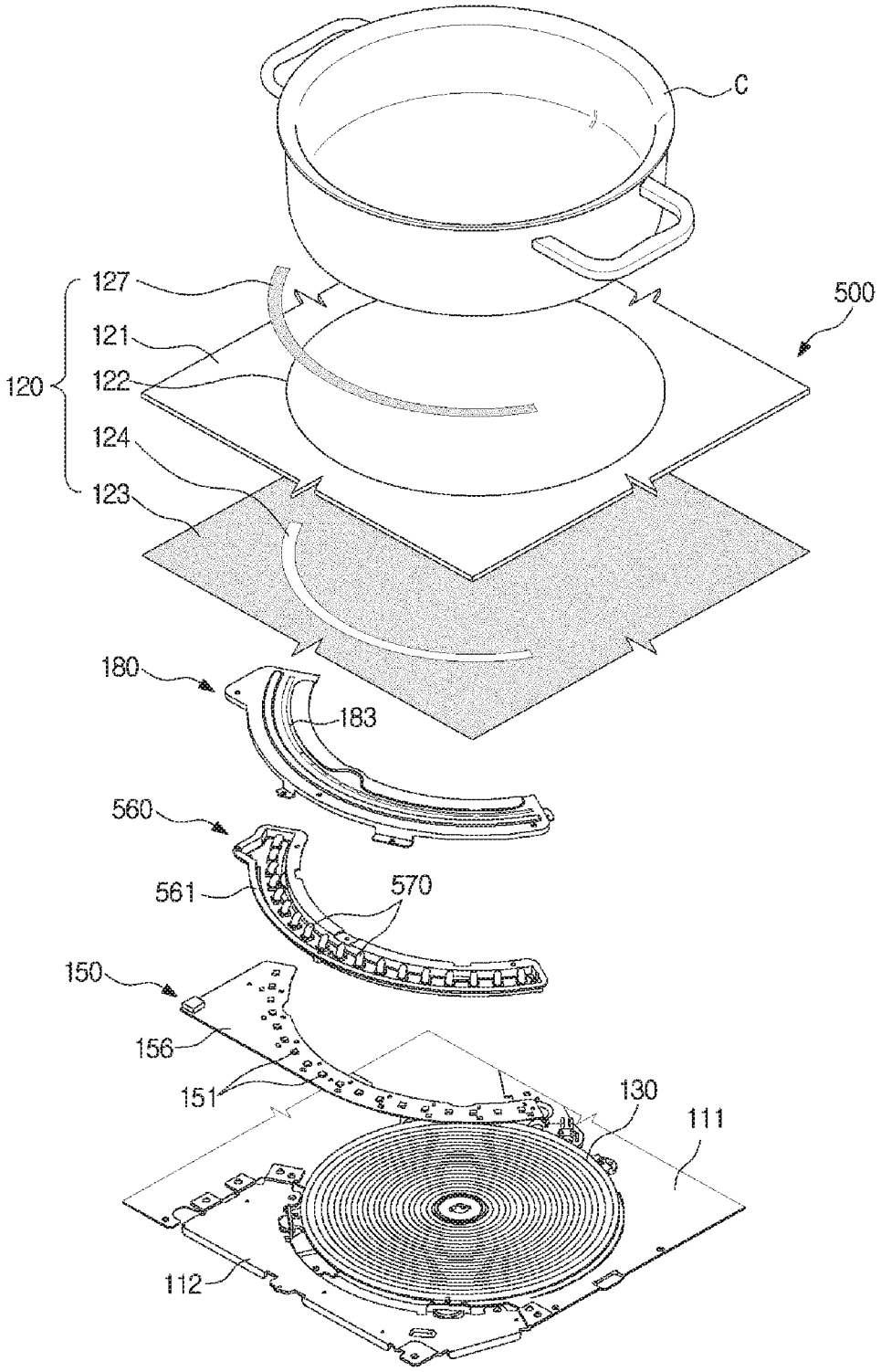

[Fig. 25]
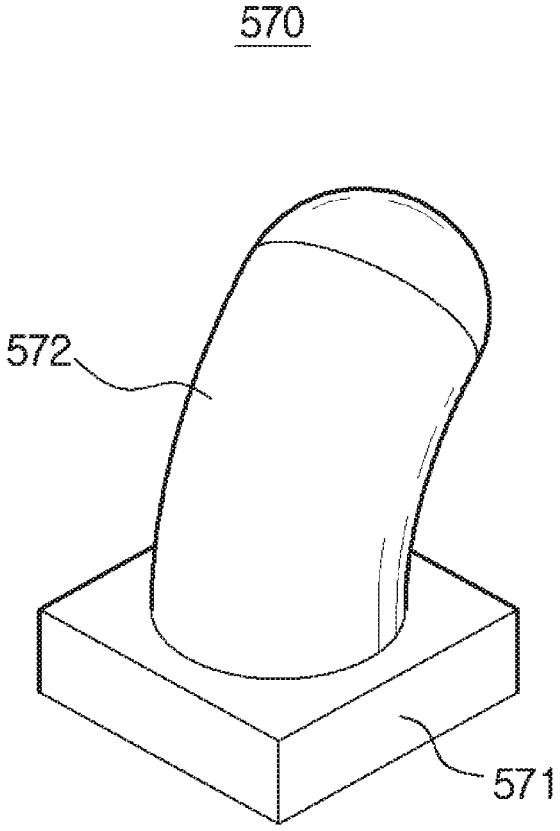

[Fig. 26]
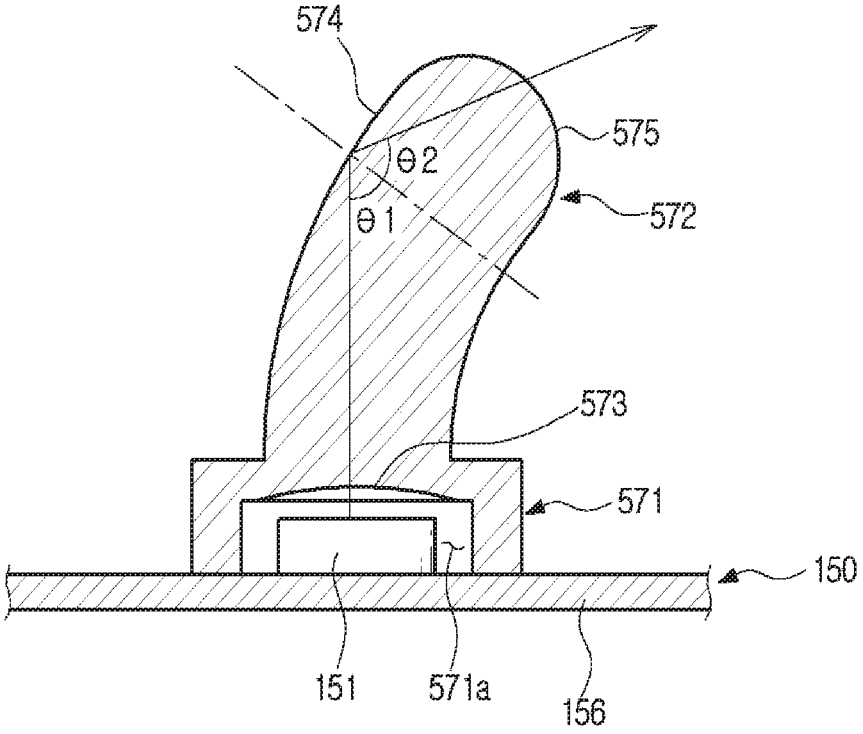

[Fig. 27]
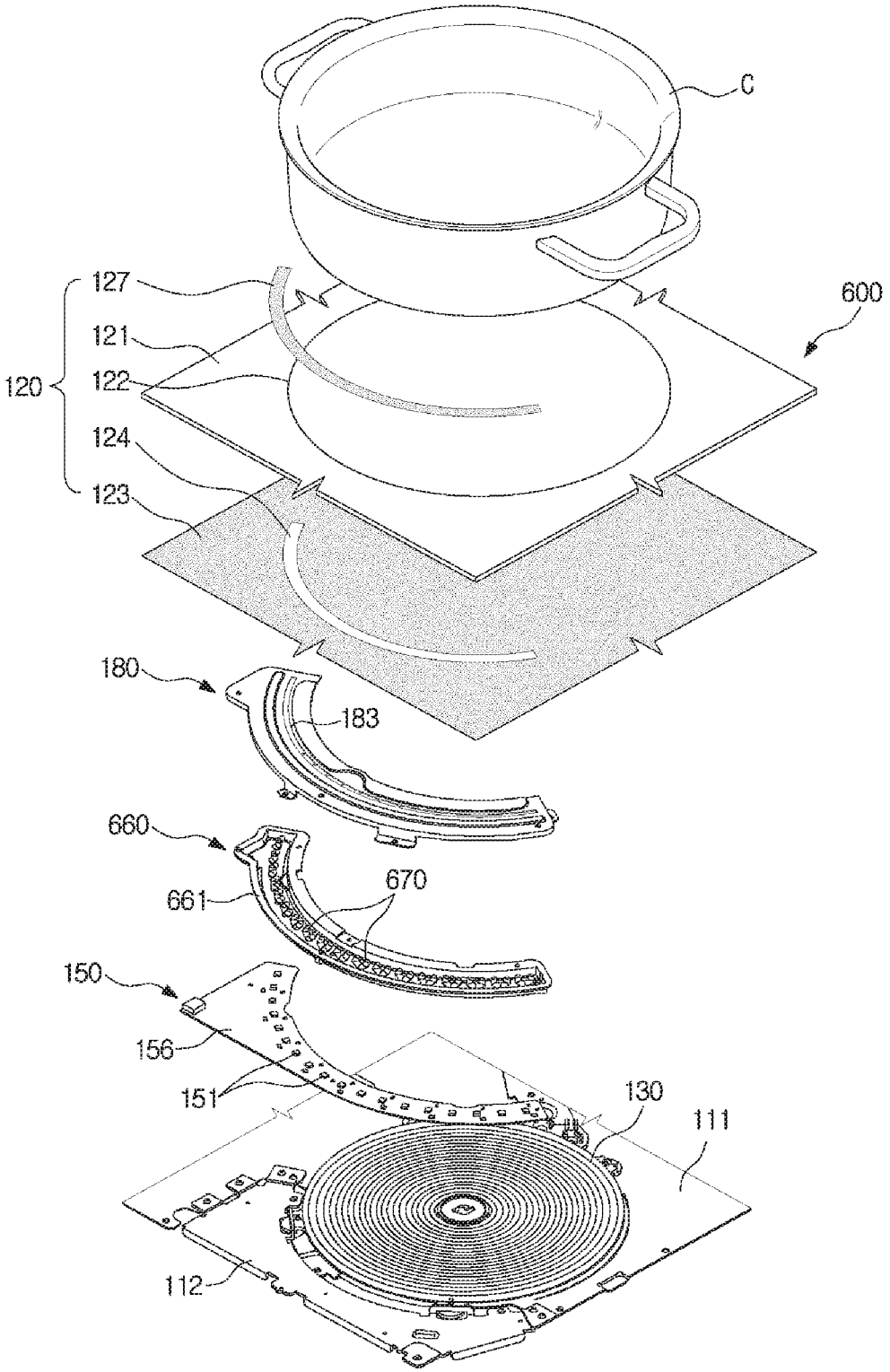

[Fig. 28]
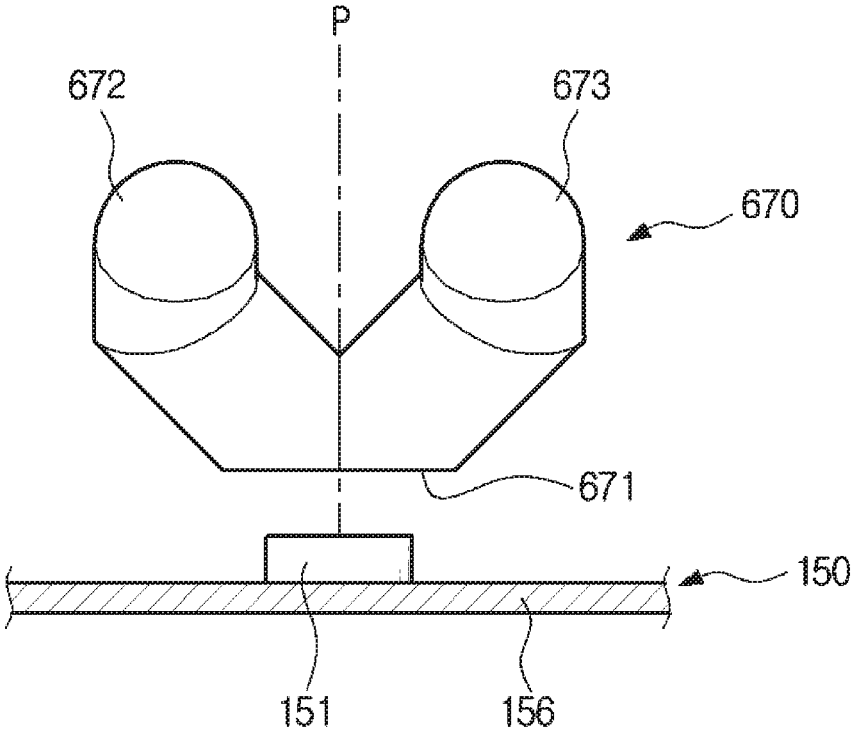

[Fig. 29]
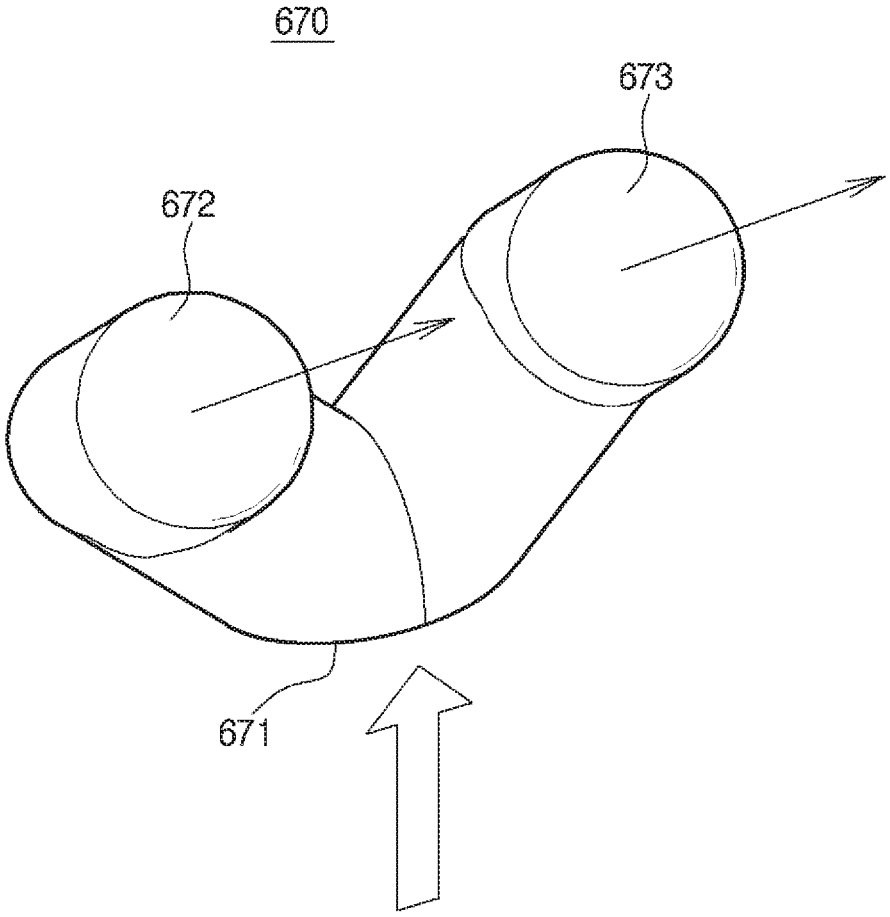

[Fig. 30]
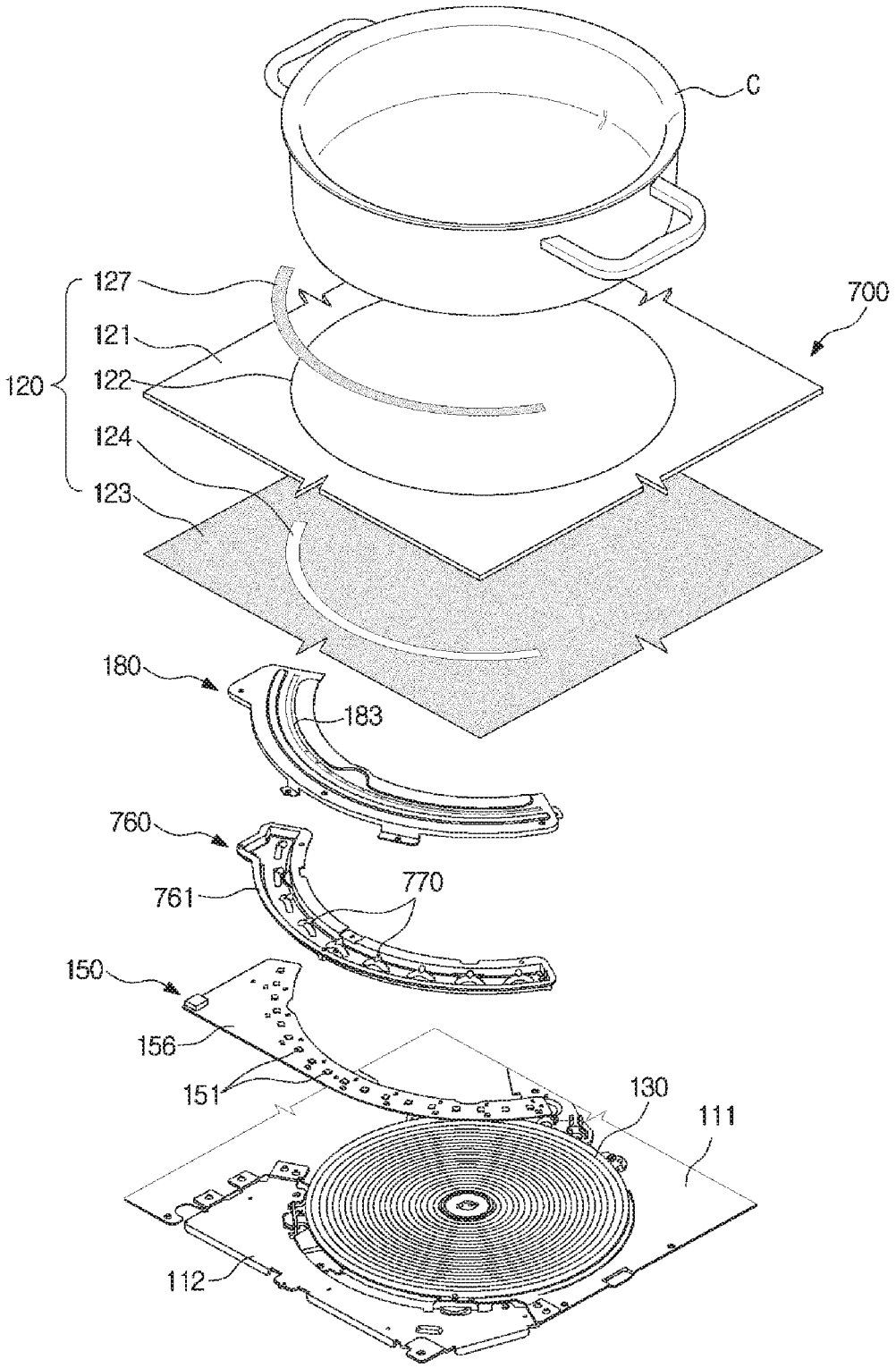

[Fig. 31]
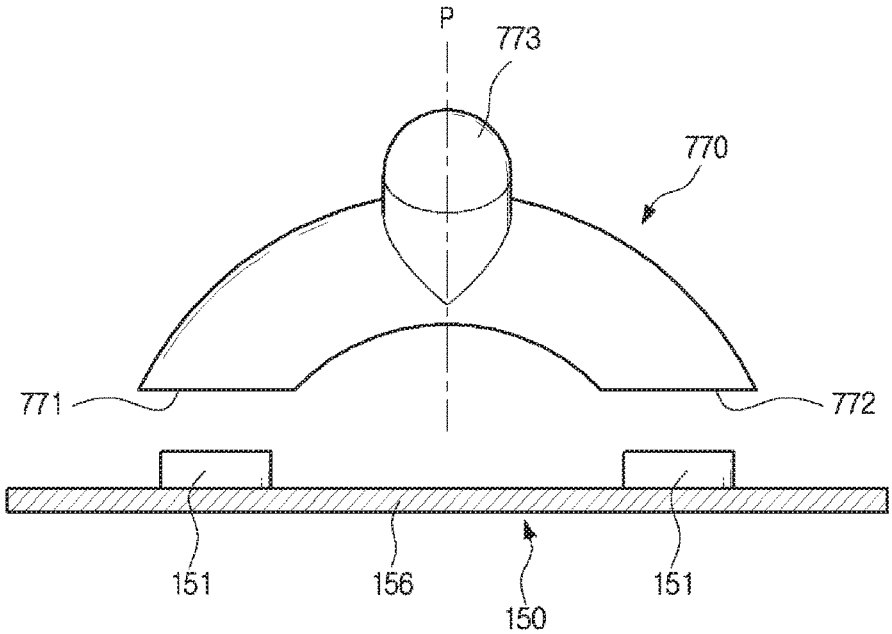
[Fig. 32]
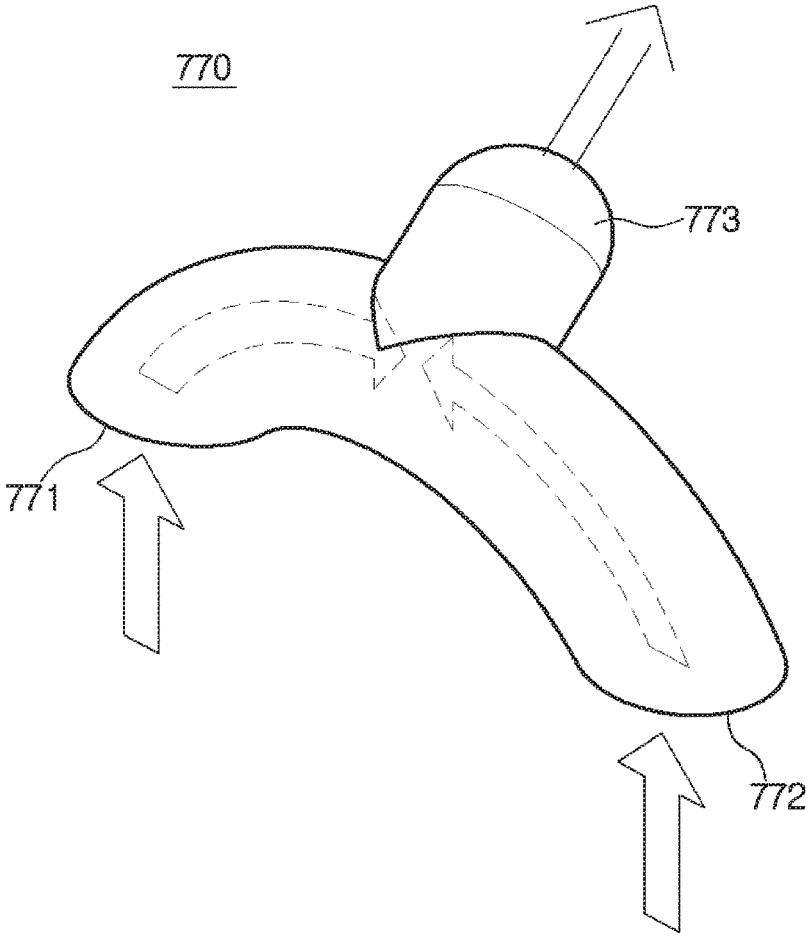

[Fig. 33]
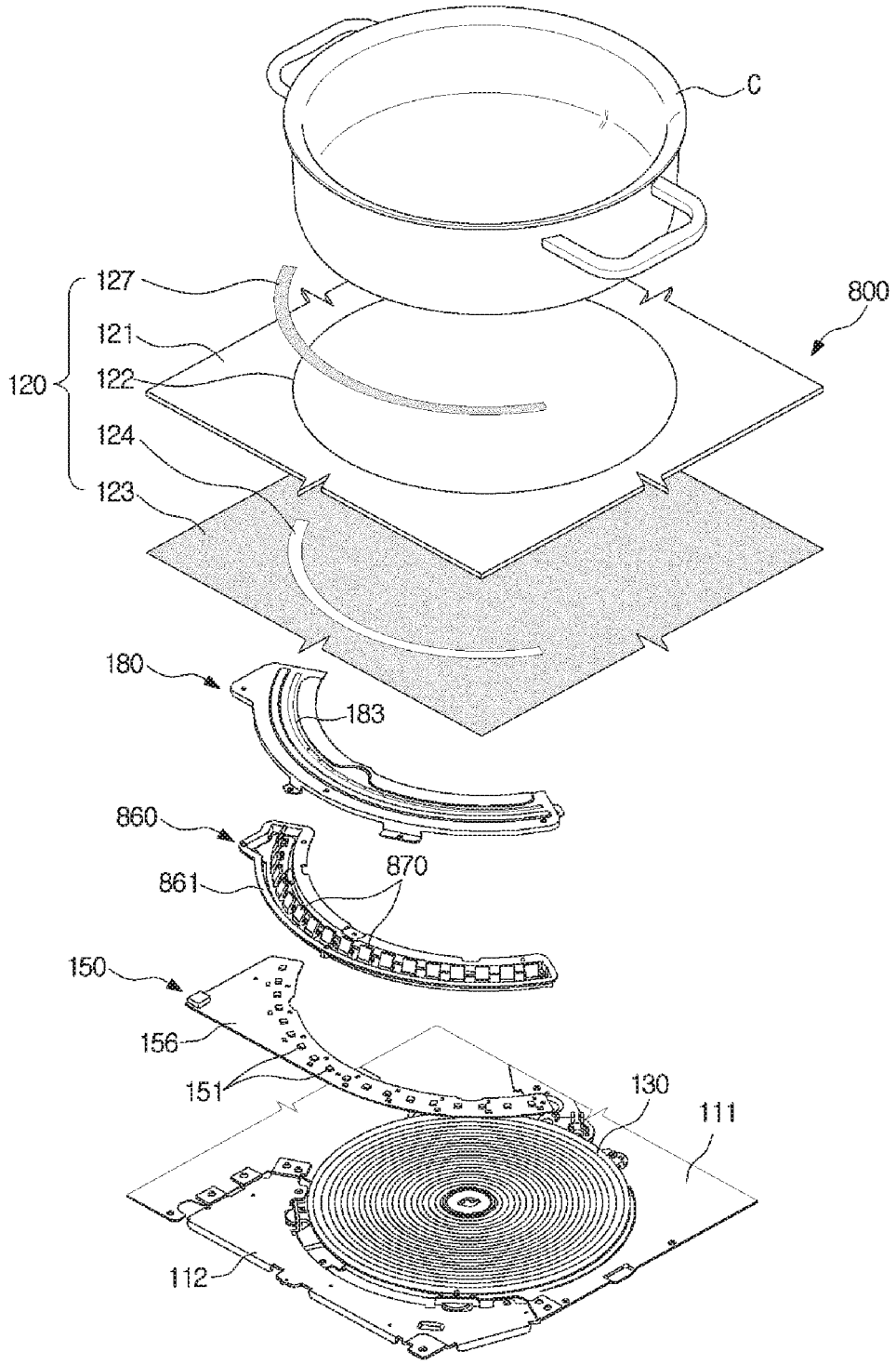

[Fig. 34]
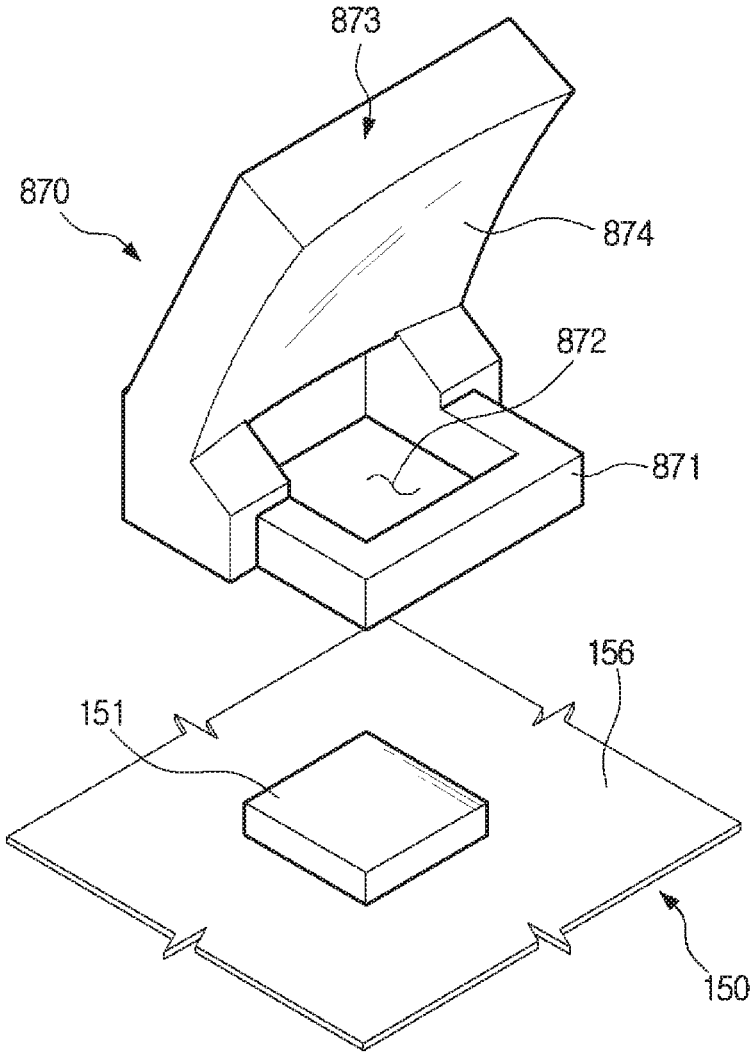

[Fig. 35]
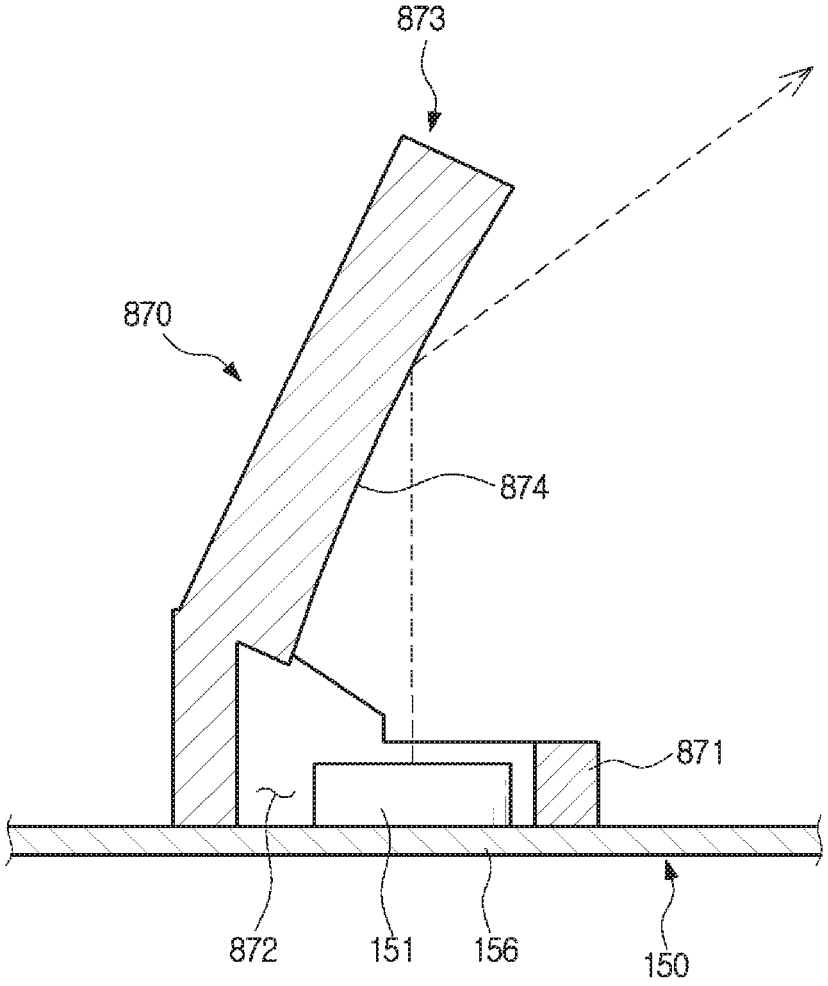

[Fig. 36]
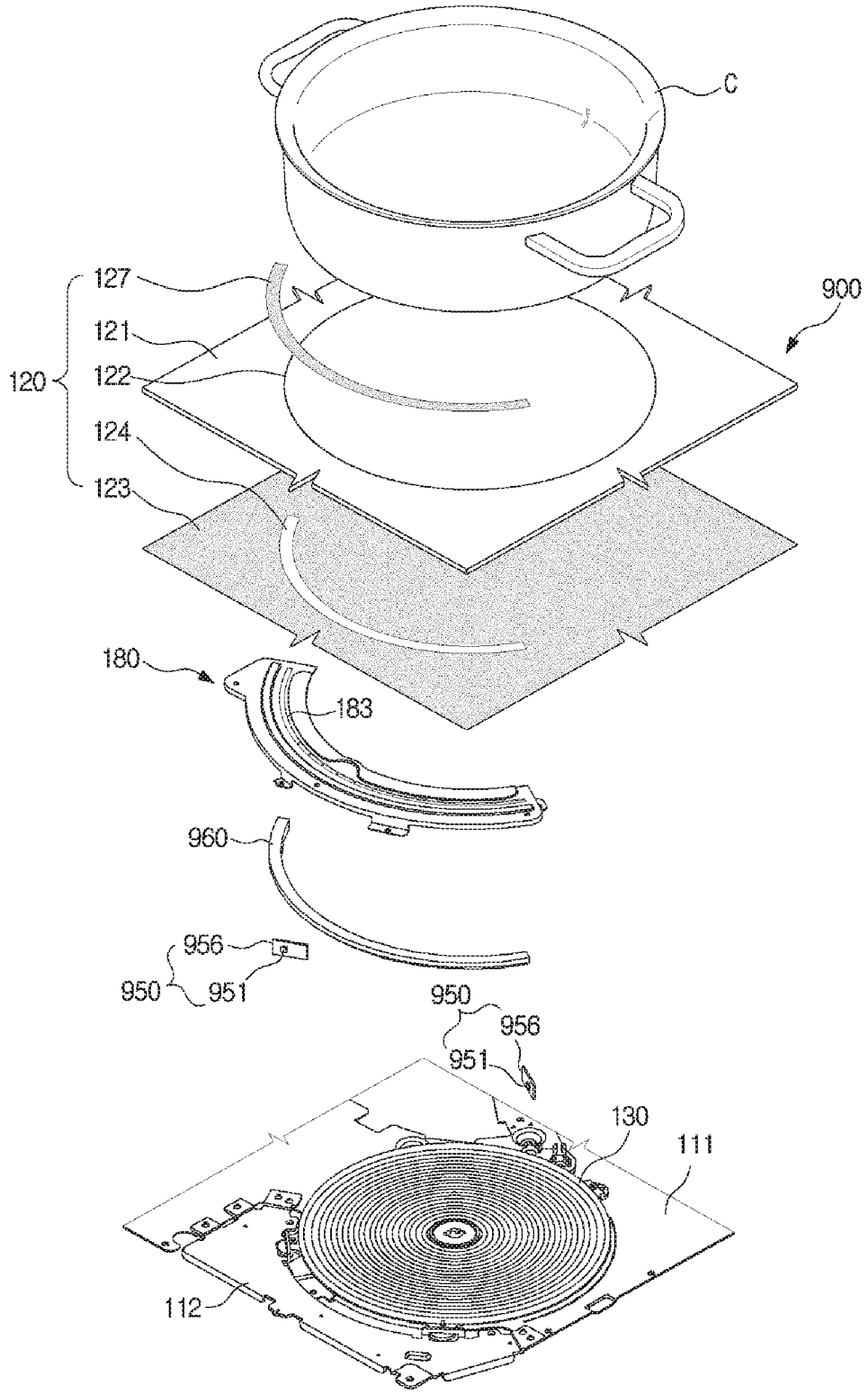

[Fig. 37]
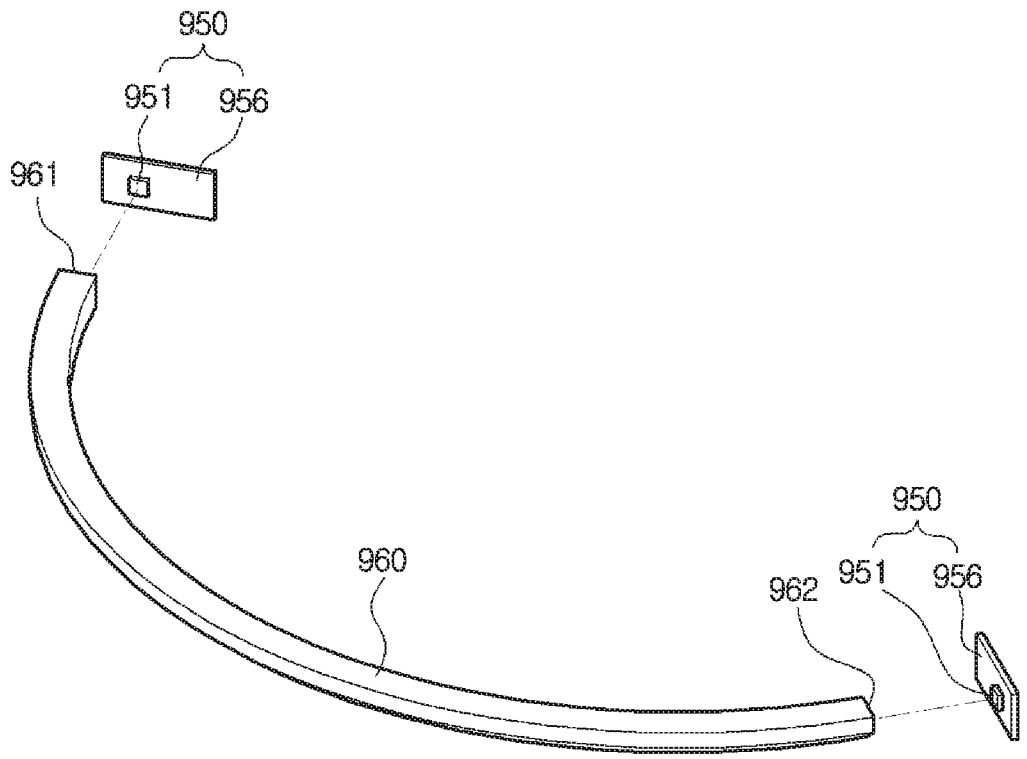
[Fig. 38]
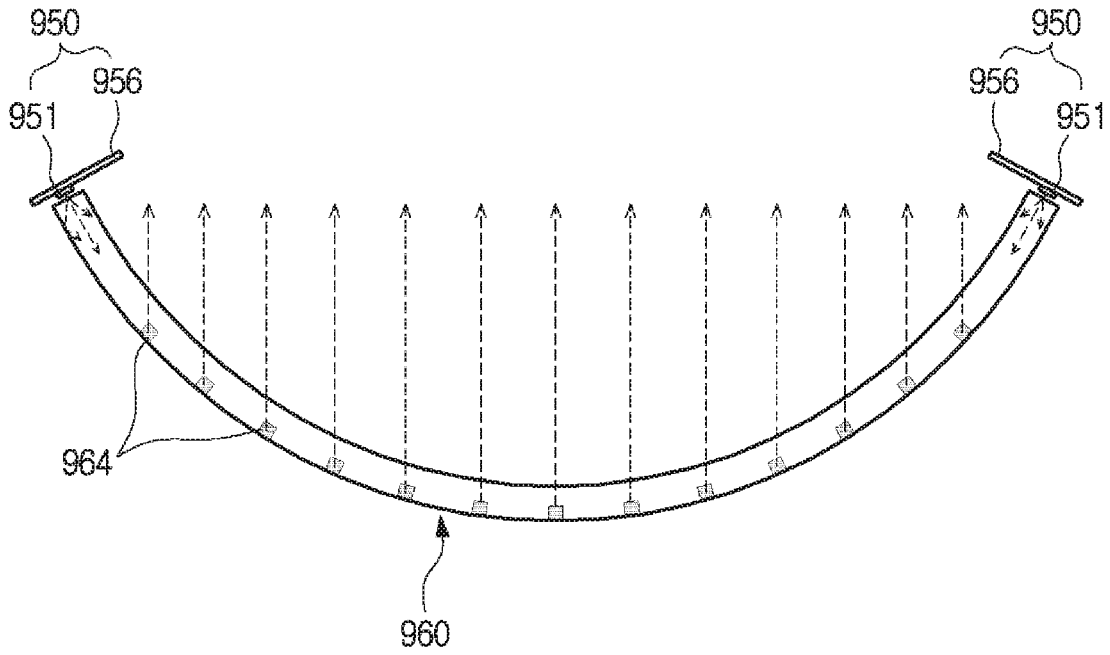

[Fig. 39]
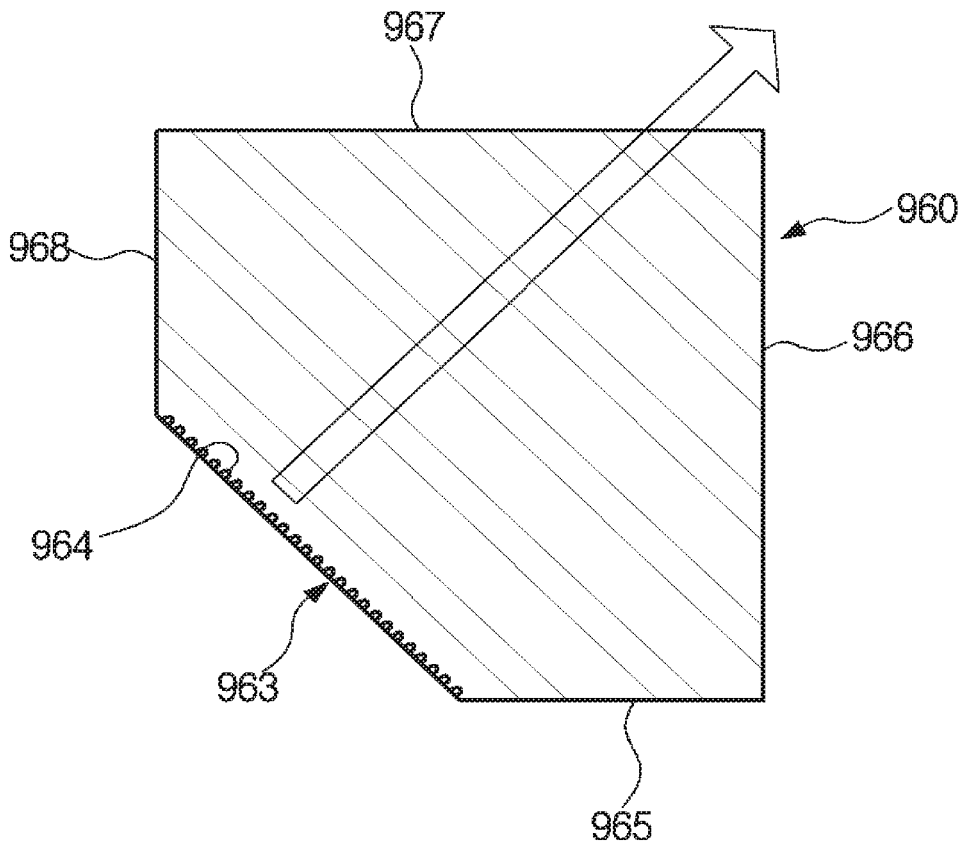

[Fig. 40]
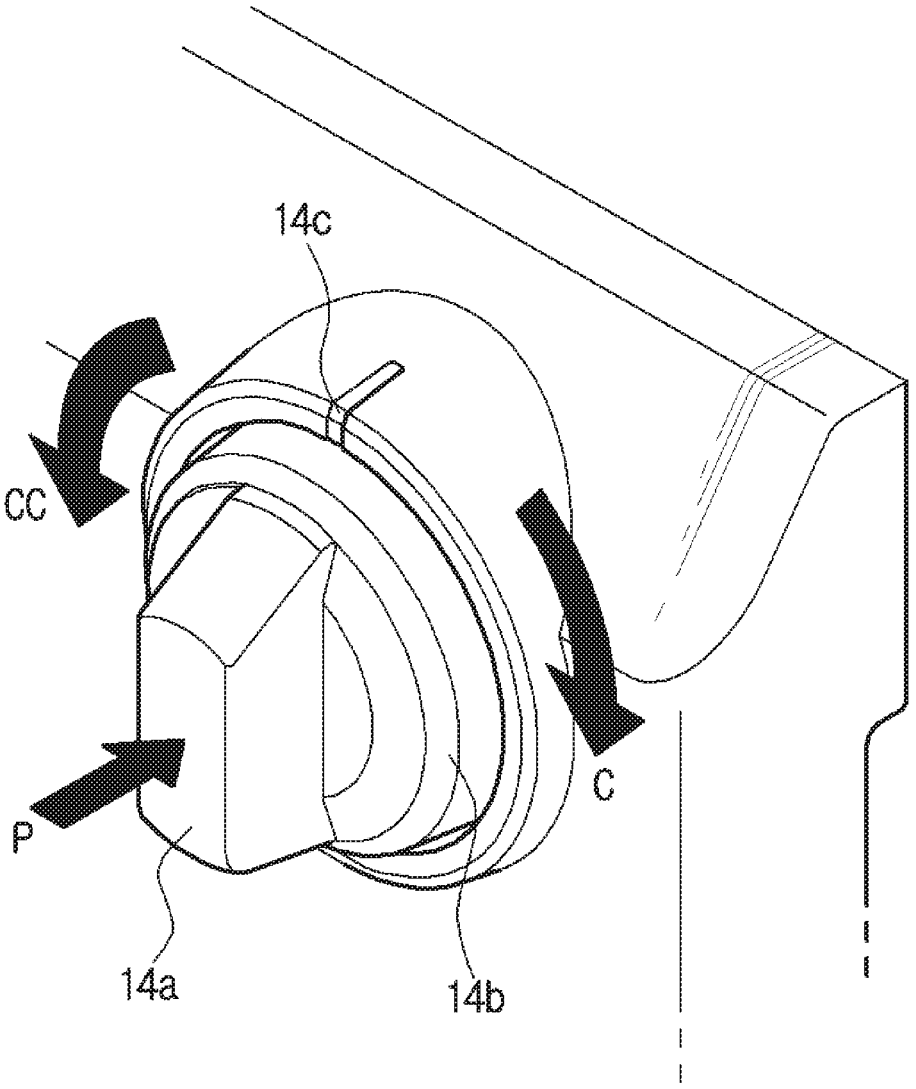

[Fig. 41]
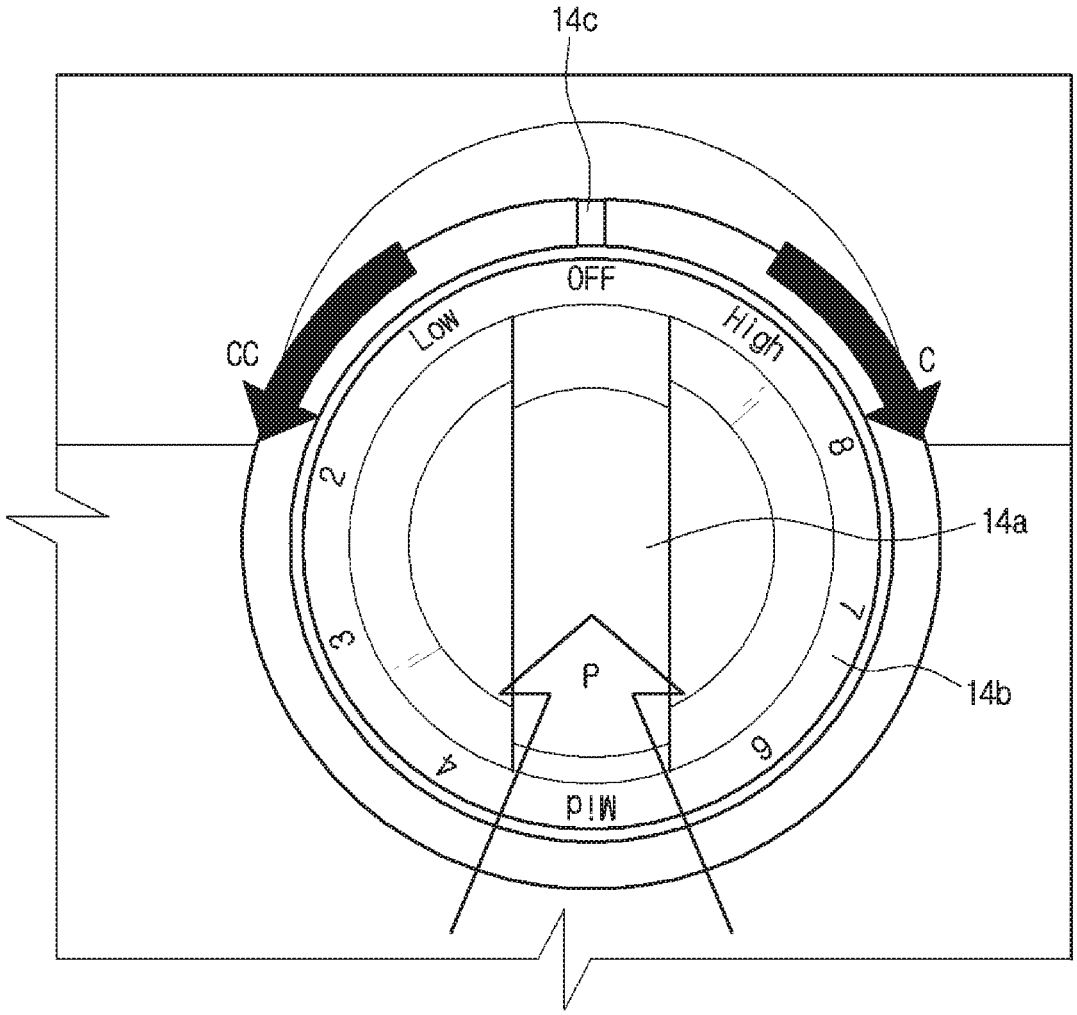

INDUCTION HEATING COOKING DEVICE

CROSS-REFERENCE TO RELATED APPLICATIONS

This application is a U.S. national stage application under 35 U.S.C. 371 of PCT international application PCT/KR2015/005038, filed on May 20, 2015 and claims the benefit of Korean Patent Application No. 10-2014-0066320, filed on May 30, 2014, respectively, the contents are incorporated herein by reference.

BACKGROUND

1. Field

The present invention relates to an induction heating cooking device in which a virtual flame image is displayed on a cooking container to easily recognize a heating state of the cooking container.

2. Description of the Related Art

An induction heating cooking device is a cooking device for heating and cooking food using a principle of induction heating. The induction heating cooking device is provided with a cooking counter on which a cooking container is put and an induction coil for generating a magnetic field when a current is applied.

When the magnetic field is generated by applying the current, a secondary current is induced to the cooking container, and Joule heat is generated due to a resistance component of the cooking container itself. Accordingly, the cooking container is heated and the food put in the cooking container is cooked.

The induction heating cooking device has some advantages that the cooking container can be more rapidly heated than a case with a gas range or a kerosene cooking stove in which a fossil fuel such as gas or oil is burned and the cooking container is heated using combustion heat and a harmful gas is not generated and there is not a fire risk.

However, since the induction heating cooking device does not generate a flame during heating of the cooking container, it is difficult to intuitively recognize a heating state of the cooking container from an outside.

Thus, a level meter type digital display may be provided at the induction heating cooking device to display the heating state of the cooking container. However, since such a digital display has low recognizability, it is difficult for a user to recognize the digital display when the user is away in a certain distance or more from the induction heating cooking device or when the user does not observe the digital display in detail, and it is difficult to be instantly recognized by the user even when the user recognizes the digital display.

SUMMARY

The present invention is directed to providing an induction heating cooking device in which a virtual flame image is displayed on a cooking container.

Also, the present invention is directed to providing an induction heating cooking device in which quality of a flame image and reliability of a product are enhanced by minimizing a distance tolerance between a light source and a main slit.

Also, the present invention is directed to providing an induction heating cooking device including a light source unit having an optical member according to various embodiments.

In accordance with one aspect of the present invention, an induction heating cooking device includes a cooking counter having an auxiliary slit for passing light; an induction coil for generating a magnetic field to inductively heat a cooking container put on the cooking counter; at least one light source disposed outside the induction coil; an optical member for changing a travelling direction of light emitted from the light source and concentrating the light; and a main slit for passing the light emitted from the optical member to form a flame image on the cooking container.

The optical member may include a convex lens.

An incident surface of the convex lens may be formed in a flat surface and also formed to be inclined with respect to the cooking counter.

An exit surface of the convex lens may be formed in a curved surface to be convex outward and also provided to be directed toward the main slit.

An incident surface of the convex lens may have a sufficient length to cover all of the light emitted from at least one chip of the light source module.

An incident surface of the convex lens may have a corrosive pattern for mixing the light emitted from a plurality of chips of the light source.

The convex lens may have an empty space formed therein in a triangular shape when being seen from a side.

The optical member may include a total reflection lens.

The total reflection lens may include a total reflection surface configured not to transmit the approaching light but to reflecting all of the light.

The light travelled to the total reflection surface of the total reflection lens may be reflected toward an exit surface of the total reflection lens.

An incident surface of the total reflection lens may be formed in a spherical surface to be convex toward an inside of the total reflection lens and thus to concentrate the light.

An exit surface of the total reflection lens may be formed in a spherical surface to be convex toward an outside of the total reflection lens and thus to concentrate the light and also provided to be directed toward the main slit.

The optical member may include a divided lens for forming a plurality of beams of light from one light source.

The divided lens may have one common incident surface and a plurality of exit surfaces.

The divided lens may be vertically symmetrical about a central surface.

The optical member may include an overlapped lens for forming one beam of light from a plurality of light sources.

The overlapped lens may have a plurality of incident surfaces and one common exit surface.

The divided lens may be vertically symmetrical about a central surface.

The optical member may include a concave mirror.

The concave mirror may include a concave reflection surface to concentrate the light.

The optical member may include an arc-shaped lighting-guide bar.

A plurality of incident surfaces may be formed at both ends of the lighting-guide bar.

The lighting-guide bar may include a reflection surface provided to be inclined with respect to the cooking counter.

The lighting-guide bar may include a plurality of reflective patterns formed at the reflection surface to be spaced apart from each other in a lengthwise direction of the lighting-guide bar and thus to reflect the light incident through the incident surface toward the main slit.

The number of flame images may be formed on the cooking container to correspond to the number of reflective patterns.

In accordance with another aspect of present invention an induction heating cooking device may include a cooking counter having an auxiliary slit; an induction coil for generating a magnetic field; a light source module having a plurality of light sources disposed outside the induction coil and a printed circuit board on which the plurality of light sources are mounted; a convex lens for changing a travelling direction of light emitted from the light source module and concentrating the light; and an optical cover having a main slit for passing the light output from the convex lens to form a flame image on a cooking container.

An incident surface of the convex lens may be formed in a flat surface and also formed to be inclined with respect to the cooking counter.

An exit surface of the convex lens may be formed in a curved surface to be convex outward and also provided to be directed toward the main slit.

An incident surface of the convex lens may have a sufficient length to cover all of the light emitted from at least one chip of the light source module.

An incident surface of the convex lens may have a corrosive pattern for mixing the light emitted from a plurality of chips of the light source.

The corrosive pattern may be molded together with the convex lens when the convex lens is molded.

The convex lens may have an empty space formed therein in a triangular shape when being seen from a side.

The convex lens may have an accommodation space for accommodating the light source.

The convex lens may include a hemispherical portion having a hemispherical exterior and a protruding portion protruding outward further than the hemispherical portion.

The number of convex lenses may be provided by the number of light sources.

The light emitted upward from the light source module may pass through the convex lens and a travelling direction thereof is changed inward to be inclined upward.

The cooking device may further include a base portion for supporting the convex lens.

The base portion may include a bottom portion horizontally formed at a lower portion thereof, a vertical portion extending from the bottom portion in a predetermined height, and a flange portion horizontally extending from the vertical portion.

The convex lens and the base portion may be integrally formed.

In accordance with another aspect of present invention, an induction heating cooking device may include a cooking counter having a cooking panel of which at least a part is formed of a transparent material and a light-shielding layer provided at a lower surface of the cooking panel to have an auxiliary slit; an induction coil for generating a magnetic field; at least one light source disposed outside the induction coil; an optical member for changing a travelling direction of light emitted from the light source module and concentrating the light; an optical source cover having a main slit for passing the light emitted from the optical member to form a flame image on a cooking container; and a screen fence provided at an upper surface of the cooking panel to minimize the light emitted from the light source from being directly exposed to a user's visual field through the auxiliary slit.

In accordance with another aspect of present invention an induction heating cooking device may include a cooking counter on which a cooking container is put;

an induction coil for generating a magnetic field to inductively heat the cooking container put on the cooking counter; a light source provided so that a light-emitting surface thereof is directed vertically; an optical member for changing a direction of light emitted from the light source to be inclined with respect to the cooking counter; and a slit for passing a part of the light output from the optical member to form a flame image on the cooking container.

In the induction heating cooking device according to the spirit of the present invention, since the flame image is formed on the surface of the lower end of the cooking container, the user can intuitively and easily recognize the heating state of the cooking container.

According to the spirit of the present invention, the virtual flame image formed on the cooking container can have a height, a width, a three-dimensional effect and a shade similar to those of an actual flame.

According to the spirit of the present invention, the distance tolerance between the light source and the main slit can be minimized and thus the quality of the flame image and the reliability of a product can enhanced.

According to the spirit of the present invention, the optical member for changing the direction of the light and concentrating the light can be realized in various types and thus can be optimized according to product specifications.

According to the spirit of the present invention, the W LEDs or the RGB LEDs can be used as the light sources, and the plurality of light sources can be individually controlled and can create various flames.

According to the spirit of the present invention, since the light emitted from the light sources can be minimized from being exposed to the user by a screen fence, the flame does not have an artificial feeling and an esthetic sense of the product can be enhanced.

According to the spirit of the present invention, since the cover portion of the light source cover extends in a direction close to the induction coil rather than the auxiliary slit, the inside of the induction heating cooking device can be prevented from being exposed through the auxiliary slit.

BRIEF DESCRIPTION OF THE DRAWINGS

FIG. 1 is a view illustrating an exterior of an oven range having an induction heating cooking device according to a first embodiment of the present invention.

FIG. 2 is an exploded view illustrating a main configuration of the induction heating cooking device of FIG. 1.

FIG. 3 is a plan view illustrating the induction heating cooking device of FIG. 1 except a cooking counter.

FIG. 4 is an exploded view of the cooking counter of the induction heating cooking device of FIG. 1.

FIG. 5 is an exploded view illustrating the light source unit of the induction heating cooking device of FIG. 1.

FIG. 6 is a view illustrating a coupling structure between the substrate supporter and the main board of the induction heating cooking device of FIG. 1.

FIG. 7 is a view illustrating a coupling structure between the printed circuit board and the substrate supporter of the induction heating cooking device of FIG. 1.

FIG. 8 is a view illustrating a coupling structure among the light source cover, the optical member and the light source module of the induction heating cooking device of FIG. 1.

FIG. 9 is a plan view illustrating the light source cover of the induction heating cooking device of FIG. 1.

FIG. 10 is a perspective view illustrating the convex lens of the induction heating cooking device of FIG. 1.

FIG. 11 is a cross-sectional view illustrating the convex lens of the induction heating cooking device of FIG. 1.

FIG. 12 is a view illustrating a length of an incident surface of the convex lens when the LED of the induction heating cooking device of FIG. 1 has three RGB chips.

FIG. 13 is an enlarged view of an A portion of FIG. 12 illustrating a corrosive pattern formed on an incident surface of a lens to mix red light, green light and blue light when the LED of the induction heating cooking device of FIG. 1 has three chips of RGB.

FIG. 14 is a view illustrating the length of the incident surface of the convex lens when the LED of the induction heating cooking device of FIG. 1 has one WHITE chip.

FIG. 15 illustrates another embodiment of the convex lens of the induction heating cooking device of FIG. 1.

FIG. 16 is a schematic view illustrating a structure in which a flame of the induction heating cooking device of FIG. 1 is formed.

FIG. 17 is a cross-sectional view illustrating a structure in which the flame of the induction heating cooking device of FIG. 1 is formed.

FIG. 18 is a view illustrating the screen fence of the induction heating cooking device of FIG. 1.

FIG. 19 is a view illustrating an action of a horizontal hairline of the surface of the cooking container put on the induction heating cooking device of FIG. 1.

FIG. 20 is a view illustrating a state in which the virtual flame image is formed on the surface of the cooking container put on the induction heating cooking device of FIG. 1.

FIG. 21 is a view schematically illustrating a main configuration of an induction heating cooking device according to a second embodiment of the present invention.

FIG. 22 is a view schematically illustrating a main configuration of an induction heating cooking device according to a third embodiment of the present invention.

FIG. 23 is a view schematically illustrating a main configuration of an induction heating cooking device according to a fourth embodiment of the present invention.

FIG. 24 is a view schematically illustrating a main configuration of an induction heating cooking device according to a fifth embodiment of the present invention.

FIG. 25 is a perspective view illustrating a structure of a total reflection lens of the induction heating cooking device of FIG. 24.

FIG. 26 is a view illustrating an action of the total reflection lens of the induction heating cooking device of FIG. 24.

FIG. 27 is a view schematically illustrating a main configuration of an induction heating cooking device according to a sixth embodiment of the present invention.

FIG. 28 is a view illustrating a structure of a divided lens of the induction heating cooking device of FIG. 27.

FIG. 29 is a view illustrating an action of the divided lens of the induction heating cooking device of FIG. 27.

FIG. 30 is a view schematically illustrating a main configuration of an induction heating cooking device according to a seventh embodiment of the present invention.

FIG. 31 is a view illustrating a structure of an overlapped lens of the induction heating cooking device of FIG. 30.

FIG. 32 is a view illustrating an action of the overlapped lens of the induction heating cooking device of FIG. 30.

FIG. 33 is a view schematically illustrating a main configuration of an induction heating cooking device according to an eighth embodiment of the present invention.

FIG. 34 is a view illustrating a structure of a concave mirror of the induction heating cooking device of FIG. 33.

FIG. 35 is a view illustrating an action of the concave mirror of the induction heating cooking device of FIG. 33.

FIG. 36 is a view schematically illustrating a main configuration of an induction heating cooking device according to a ninth embodiment of the present invention.

FIG. 37 is a view illustrating a structure of a lighting-guide bar of the induction heating cooking device of FIG. 36.

FIG. 38 is a view illustrating a reflection pattern of the lighting-guide bar of the induction heating cooking device of FIG. 36.

FIG. 39 is a view illustrating an action of the lighting-guide bar of the induction heating cooking device of FIG. 36.

FIGS. 40 and 41 are enlarged views illustrating an operation unit of the induction heating cooking device of FIG. 1.

DETAILED DESCRIPTION

Hereinafter, exemplary embodiments of the present invention will be described in detail.

FIG. 1 is a view illustrating an exterior of an oven range having an induction heating cooking device according to a first embodiment of the present invention. FIG. 2 is an exploded view illustrating a main configuration of the induction heating cooking device of FIG. 1. FIG. 3 is a plan view illustrating the induction heating cooking device of FIG. 1 except a cooking counter.

Referring to FIGS. 1 to 3, an oven range 1 may integrally include an oven 10 provided at a lower portion thereof and an induction heating cooking device 100 provided at an upper portion thereof. The induction heating cooking device 100 according to an embodiment of the present invention may be integrally formed with the oven 10 or may be separately provided from the oven 10.

The oven 10 may generate high-temperature heat using gas or electricity and may cook food inside a cavity by convection of air. Doors 11 and 12 of the oven 10 may be provided at a front surface of the oven range 1. Each of the doors 11 and 12 of the oven 10 may be rotated about a hinge shaft to be opened and closed. A display unit 13 for displaying an operating state of the oven 10 or the induction heating cooking device 100 and an operation unit 14 for receiving an input of an output level of the oven 10 or the induction heating cooking device 100 may be provided above the doors 11 and 12 of the oven 10.

The induction heating cooking device 100 may include a main body 110, a cooking counter 120 on which a cooking container is put, an induction coil 130 generating a magnetic field to inductively heat the cooking container, a light source unit 140 for emitting light, a power supply unit for supplying an electric power to the induction coil 130 and the light source unit 140 or cutting off the power supply, a light source controller 115 for controlling turning-on, turning-off and brightness of the light source unit 140, a cooling unit 116 for cooling various electronic components and the light source unit 140, and an auxiliary display unit 119 for displaying operation information of the induction heating cooking device 100.

The main body 110 is formed in an approximately box shape of which an upper surface is opened, and the cooking counter 120 may be coupled to the opened upper surface of the main body 110. A main board 111 is provided inside the main body 110, and the induction coil 130 may be supported by the main board 111. A machinery chamber 114 may be formed under the main board 111.

The cooking counter 120 may have a flat shape to horizontally support the cooking container.

The induction coil 130 is horizontally arranged under the cooking counter 120. The induction coil 130 may be installed on an induction coil supporter 131 (FIG. 17) installed at the main board 111. In the embodiment, four induction coils 130 including one large-sized induction coil, two middle-sized induction coils and one small-sized induction coil may be provided, but the number of induction coils 130 is not limited.

In the embodiment, the induction coil 130 is formed in an approximately circular shape. However, the induction coil 130 is not limited thereto and may be formed in a quadrangular shape or various other shapes.

When a current is applied to the induction coil 130, the induction coil 130 may vertically form a magnetic field. Due to the magnetic field, a secondary current is induced to the cooking container put on the cooking counter 120, and Joule heat may be generated by a resistance component of the cooking container itself. Accordingly, the cooking container is heated, and thus the food put in the cooking container may be cooked. The cooking container should have an iron content or a magnetic property.

The number of light source units 140 may be provided to correspond to the number of induction coils 130. The light source unit 140 may be installed on a substrate supporter 112. The substrate supporter 112 may be described later. The light source unit 140 may be provided at a radial outside thereof in a circumferential direction of the induction coil 130.

In the embodiment, with regard to the induction coil formed in an approximately circular shape the light source units 140 may be provided in an angular range of about 120 degrees at a front of the induction heating cooking device but are not limited thereto. For example, the light source units 140 may be provided in a range of about 180 or 360 degrees. However, since the induction heating cooking device is generally disposed at a wall surface of a kitchen and a user usually sees only a front surface of the induction heating cooking device, it is not necessary to dispose the light source units 140 at a rear surface and a side surface of the induction heating cooking device and an effect of the present invention may be achieved by just providing the light source units 140 in the range of about 120 degrees.

The light source units 140 may form a flame image on a surface of a lower end of the cooking container so that the user can intuitively recognize a heating state of the cooking container when the current is applied to the induction coil 130 and the cooking container is heated (FIG. 20). At this time, the cooking container may serve as a screen on which the light is projected.

The light source units 140 may include a light source module 150 (FIG. 5) having a light source 151 (FIG. 5) and a printed circuit board 156 (FIG. 5), an optical member 160 (FIG. 5) for changing a direction of light emitted from the light source module 150 and concentrating the light, and a light source cover 180 (FIG. 5) having a main slit 183 (FIG. 5) through which the light emitted from the optical member 150 passes so as to form the flame image on the lower end of the cooking container. A detailed configuration of the light source unit 140 will be described later.

The light source controller 115 may control the turning-on, the turning-off and the brightness of the light source. The light source controller 115 may control an amount of the current applied to the light source and may adjust a size and a brightness of the virtual flame image.

Also, when a plurality of light sources are included in the light source module 140, the light source controller 115 may control all of the plurality of light sources at the same time, may individually control each of the plurality of light sources, or may divide the plurality of light sources into sections and may divisionally or sequentially control the sections. Therefore, the flame image may be variously created. For example, the flame may be sequentially turned on or off in one direction when an heating operation starts or is terminated, or some or all of the flames may be flashed on and off at short intervals to attract the user's attention.

The cooling unit 116 may include a fan 117 for forcibly flowing air, a heat sink 118, and a duct (not shown) for guiding a flow of the air. The cooling unit 116 may release heat generated from the induction coil 130 and the light source unit 140 by circulating the air in the machinery chamber 114.

The auxiliary display unit 119 may indicate whether the induction heating cooking device is operated using a level meter or may indicate a heating temperature or an operation time of the induction heating cooking device using a 7-digit segment.

FIG. 4 is an exploded view of the cooking counter of the induction heating cooking device of FIG. 1. The cooking counter of the induction heating cooking device according to the first embodiment of the present invention will be described with reference to FIG. 4.

The cooking counter 120 supports the cooking container. The cooking counter 120 includes a cooking panel 121 formed of a transparent material and a light-shielding layer 123 provided at a lower surface of the cooking panel 121 and having an auxiliary slit 124.

The cooking panel 121 has a flat plate shape and should also have a sufficient strength to support the cooking container and a heat-resisting property to endure heat. To this end, the cooking panel 121 may be formed of a reinforced heat-resistant glass or a reinforced ceramic material.

The cooking panel 121 is formed of a transparent material so that the light emitted from the light source unit 140 passes therethrough and then is projected to the cooking container. However, since it is sufficient for the cooking panel 121 to pass only a part of a beam of light emitted from the light source unit 140 which forms the flame image, the entire cooking panel 121 does not need to be transparent, and only a part thereof may be formed to be transparent.

That is, an entire area of the cooking panel 121 does not need to be formed in a transparent material, and only a part thereof through which the beam of light directed toward the cooking container may pass may be formed of the transparent material, and the remaining area may be formed of an opaque material, and thus a manufacturing cost of the cooking panel 121 may be reduced.

The light-shielding layer 123 prevents various components provided under the cooking panel 121 from being exposed to an outside. Therefore, the light-shielding layer 123 may have a black color having a low light transmittance.

The auxiliary slit 124 is formed at the light-shielding layer 123 not to block the beam of light directed toward the cooking container. The auxiliary slit 124 allows the light emitted from the light source unit 140 and passed through the main slit 183 (FIG. 17) of the light source cover 180 (FIG. 17) not to be blocked by the light-shielding layer 123 but to be projected to the cooking container. The auxiliary slit 124 may be formed at a radial inside of an upper (above) side of the main slit 183.

It is preferable that the auxiliary slit 124 does not have an influence on a size of the flame image. This is because the auxiliary slit 124 is more distant from the light source 151 (FIG. 17) than the main slit 183 and thus a distance tolerance between the light source 151 and the auxiliary slit 124 may be increased.

Therefore, a thickness D2 (FIG. 17) of the auxiliary slit 124 may be formed thicker than that D1 (FIG. 17) of the main slit 183 so that the light passed through the main slit 183 is not blocked but passes therethrough.

The auxiliary slit 124 is formed in an arc shape and may be formed in a range of about 120 degrees in a circumferential direction. However, the auxiliary slit 124 is not limited thereto and may be formed in various angular ranges such as 180 and 360 degrees.

The auxiliary slit 124 may be continuously formed in the circumferential direction. However, the auxiliary slit 124 is not limited thereof and may be discontinuously formed to correspond to the number of a plurality of beams of light.

The light-shielding layer 123 may include an UI hole 125 through which the light emitted from the auxiliary display unit 119 (FIG. 2) passes.

The light-shielding layer 123 may be provided in a separate sheet shape and then may be attached to the lower surface of the cooking panel 121 by an adhesive member.

Alternatively, the light-shielding layer 123 may be printed on the lower surface of the cooking panel 121. A glassware printing may be used as a printing method thereof. The glassware printing is a printing method in which a pattern is applied to glass and an ink is coated thereon and then heated at a high temperature as if baking pottery and thus the ink is impregnated in the glass.

The cooking counter 120 may include a screen fence 127 provided on an upper surface of the cooking panel 121 to minimize the light of the light source unit 140 from being directly exposed to the user, thereby concealing the light source 151. The screen fence 127 may have a block color having a low light transmittance.

The screen fence 127 is formed in an arc shape and may be formed in a range of about 120 degrees in the circumferential direction. However, the screen fence 127 is not limited thereto and may be formed in various angular ranges such as 180 and 360 degrees.

The screen fence 127 may be provided to extend from a vertical upper side of the auxiliary slit 124 toward a radial outside thereof. As described above, when the screen fence 127 is disposed from the vertical upper side of the auxiliary slit 124 toward the radial outside thereof, the beam of light directed to be inclined upward from the light source unit 140 toward the cooking container may not be blocked and the light passed through the auxiliary slit 124 may also be minimized from being directly exposed to a user's visual field (referring to FIG. 18).

Since the light source 151 is minimized by the screen fence 127 from being directly exposed to the user, the user may not recognize existence of the light source 151, and thus a feeling that the flame image is artificially formed may not be provided, and an esthetic sense of the product may be enhanced.

The screen fence 127 may be provided in a separate sheet shape and then may be attached to the upper surface of the cooking panel 121 by an adhesive member. Alternatively, the screen fence 127 may be printed on the upper surface of the cooking panel 121. The glassware printing may be used as a printing method thereof.

The cooking counter 120 may include a container guide line 122 for guiding an appropriate position of the cooking container. The container guide line 122 may have an approximate size corresponding to a size of the induction coil 130. The container guide line 122 may be formed by a printing or an attaching.

FIG. 5 is an exploded view illustrating the light source unit of the induction heating cooking device of FIG. 1. FIG. 6 is a view illustrating a coupling structure between the substrate supporter and the main board of the induction heating cooking device of FIG. 1. FIG. 7 is a view illustrating a coupling structure between the printed circuit board and the substrate supporter of the induction heating cooking device of FIG. 1. FIG. 8 is a view illustrating a coupling structure among the light source cover, the optical member and the light source module of the induction heating cooking device of FIG. 1. FIG. 9 is a plan view illustrating the light source cover of the induction heating cooking device of FIG. 1.

A configuration of the light source unit 140 of the induction heating cooking device 100 according to the first embodiment of the present invention will be described with reference to FIGS. 5 to 9.

The light source unit 140 may include the light source module 150 for emitting a plurality of beams of light, the optical member 160 for refracting or reflecting the light emitted from the light source module 150 and changing a travelling direction of the light and also concentrating the light, and the light source cover 180 having the main slit 183 for passing the light of which the travelling direction is changed and which is concentrated by the optical member 160 and thus forming the flame image on the surface of the cooking container.

The light source module 150 includes the light source 151 for emitting the light, and the printed circuit board 156 on which the light source 151 is mounted and supplying the electric power to the light source 151.

In the embodiment, an LED (light emitting diode) is used as the light source 151. The LED 151 has advantages of a small size, excellent light-emitting efficiency and a long life span. However, the light source 151 does not always include only the LED 151 and may include various light-emitting means such as a cold cathode fluorescent lamp, an external electrode fluorescent lamp and a carbon nano-tube lamp.

The light source module 150 may have the number of LEDs 151 corresponding to the number of flame images intended to be formed on the cooking container. That is, one LED 151 may form one flame image. The LEDs 151 may be arranged to be spaced apart from each other at predetermined intervals in a circumferential direction of the induction coil 130. The LEDs 151 may be arranged in front of the induction heating cooking device 100 within an angular range of about 120 degrees. However, the LEDs 151 are not limited thereto and may be arranged in a range of 180 or 360 degrees.

The LED 151 may be a white LED (FIG. 14) having one chip or an RGB LED (FIGS. 11 and 12) having three chips. When the RGB LEDs having a red color, a green color and a blue color are used, a color further similar to an actual flame may be realized by combining each of the colors.

In the embodiment, the LED 151 is an SMD (surface mount device) type LED used in a mounted state on the printed circuit board 156, and a COB (chip on board) type LED in which an LED chip itself is mounted and molded on the printed circuit board 156 may also be used.

The LED 151 may be mounted on an upper surface of the printed circuit board 156 so that a light-emitting surface thereof is directed upward. That is, the LED 151 may emit upward light at a predetermined pointing angle. For example, in the embodiment, the pointing angle of the LED 151 may be about 120 degrees.

The printed circuit board 156 on which the LED 151 is mounted is provided to be horizontal with respect to the cooking counter 120. In particular, the printed circuit board 156 may be mounted on the separate substrate supporter 112 rather than the main board 111 so that flatness thereof may be generally uniformly maintained.

The substrate supporter 112 is molded separately from the main board 111 and then coupled to the main board 111. Since the main board 111 has a large size, it is difficult to generally uniformly maintain the flatness. However, the substrate supporter 112 has a small size corresponding to a size of the printed circuit board 156 and thus the flatness thereof may be generally uniformly maintained.

As illustrated well in FIG. 6, the substrate supporter 112 may have a flat portion 112*a* on which the printed circuit board 156 is mounted and supported and a coupling portion 112*b* coupled to the main board 111. The flat portion 112*a* may be formed to be flat without being curved, such that all of a plurality of LEDs 151 mounted on the printed circuit board 156 emit the light in the same direction.

A plurality of coupling portions 112*b* may be formed to protrude outside the flat portion 112*a* and may be firmly coupled to the main board 111 by a fastening member S1 such as a screw.

As illustrated well in FIG. 7, the printed circuit board 156 on which the LEDs 151 are mounted may be installed on an upper surface of the flat portion 112*a* of the substrate supporter 112. The printed circuit board 156 may be firmly coupled to the substrate supporter 112 by a fastening member S2.

Accordingly, the plurality of LEDs 151 mounted on the printed circuit board 156 may be formed so that a direction of the light emitted from each of them becomes the same as each other. Therefore, the sizes and the brightnesses of the flame image formed on the cooking container may have unity, and reliability of a product may be enhanced.

The optical member 160 refracts or reflects the light emitted from the LED 151, changes the travelling direction thereof and concentrates the light. Since the light is concentrated by the optical member 160, a going-straight property of the light can be enhanced, and the brightness of the flame image may also be increased.

The optical member 160 of the induction heating cooking device according to the first embodiment of the present invention includes a convex lens 170 for refracting and concentrating the light and a base portion 161 for supporting the convex lens 170. The convex lens 170 and the base portion 161 of the optical member 160 may be integrally formed. The convex lens 170 and the base portion 161 of the optical member 160 may be integrally injection-molded with a resin material such as silicone. Alternatively, the convex lens 170 and the base portion 161 may be formed of a glass material.

The number of convex lenses 170 is provided to correspond to the number of LEDs 151 and also provided to be spaced apart from each other in a circumferential direction, thereby corresponding to the LEDs 151.

The convex lens 170 changes the travelling direction of the light emitted vertically upward from the LED 151 to be inclined upward toward the main slit 183 and the cooking container. A detailed configuration of the convex lens 170 will be described later.

The base portion 161 may include a bottom portion 162 (FIG. 17) horizontally formed at a lower portion thereof, a vertical portion 163 (FIG. 17) extending from the bottom portion 162 in a predetermined height, and a flange portion 164 (FIG. 17) horizontally extending from the vertical portion 163 to be in close contact with and coupled to the light source cover 180. The convex lens 170 may be formed at the bottom portion 162. The bottom portion 162 may include a close-contacting protrusion 162*a* (FIG. 11) protruding downward to be in close contact with the printed circuit board 156. The vertical portion 163 may block the heat generated from the induction coil 130 from being transmitted to the convex lens 170 and the light source 151. The optical member 160 may be fixed to the printed circuit board 156 and the substrate supporter 112 by a fastening member S3 such as a screw.

The light source cover 180 may cover the convex lens 170 and may prevent foreign substances from being introduced into the convex lens 170.

The light source cover 180 includes a first cover portion 181 provided at a radial outside thereof, a second cover portion 182 provided at a radial inside thereof, and the main slit 183 formed between the first cover portion 181 and the second cover portion 182. The first cover portion 181 and the second cover portion 182 may be in close contact with the flange portion 164 of the optical member 160.

The main slit 183 of the light source cover 180 serves to pass the light emitted from the LED 151 and thus to form the flame image on the cooking container. The light source cover 180 passes, through the main slit 183, a part of the beams of light emitted from the LED 181 which is directed toward the cooking container and blocks the remaining beams of light.

The main slit 183 is located at a radial inside of a vertical upper side of the LED 151. Therefore, the light emitted from the LED 151 travels to be inclined upward toward the main slit 183.

The main slit 183 may be formed in a predetermined angular range in the circumferential direction. In the embodiment, the main slit 183 has been formed in the range of 120 degrees in the circumferential direction. However, the main slit 183 is not limited thereto and may also be formed in a range of 180 or 360 degrees.

The main slit 183 may be continuously formed with a predetermined thickness D1 (FIG. 17) in the circumferential direction. Therefore, the main slit D1 may influence only a height of the flame image and may not influence a width of the flame image. That is, the height of the flame image is determined by the thickness of the main slit D1, but the width of the flame image may be determined by shapes of the LED 151 and the convex lens 170.

The light source cover 180 may have at least one reinforcing bridge 184 (FIG. 9) formed at the main slit 183 to constantly maintain the thickness D1 of the main slit 183 and also to prevent a deformation of the main slit 183 due to an external force.

The reinforcing bridge 184 is provided to connect the first cover portion 181 with the second cover portion 182 and thus to cross the main slit 183. One or more reinforcing bridges 184 may be formed at positions, which do not interfere with the beams of light, not to influence the flame image.

The light source cover 180 may be coupled to the optical member 160 by a coupling protrusion structure or a fastening member. The coupling protrusion structure may include a coupling hole 185 formed at the light source cover 180 and a coupling protrusion 164*a* formed at the optical member 160. Also, the light source cover 180 may be coupled to the substrate supporter 112 by a fastening member S4.

As a result, due to such a configuration, the light source module 150, the optical member 160 and the light source cover 180 may be integrally coupled to the substrate supporter 112. Therefore, a distance tolerance between the LED 151 of the light source module 150 and the main slit 183 of the light source cover 180 may be minimized.

A distance between the LED 151 of the light source module 150 and the main slit 183 of the light source cover 180 is a factor having the greatest influence on the size and the brightness of the flame image formed on the cooking container. As described above, in the induction heating cooking device according to the first embodiment of the present invention, the printed circuit board 156 of the light source module 150 is installed at the substrate supporter 112 provided separately from the main board 111 to have high flatness, and the light source module 150, the optical member 160 and the light source cover 180 are integrally coupled, and thus the distance tolerance between the LED 151 of the light source module 150 and the main slit 183 of the light source cover 180 is minimized. Therefore, the quality of the flame image and the reliability of the product may be enhanced.

FIG. 10 is a perspective view illustrating the convex lens of the induction heating cooking device of FIG. 1. FIG. 11 is a cross-sectional view illustrating the convex lens of the induction heating cooking device of FIG. 1. FIG. 12 is a view illustrating a length of an incident surface of the convex lens when the LED of the induction heating cooking device of FIG. 1 has three RGB chips. FIG. 13 is an enlarged view of an A portion of FIG. 12 illustrating a corrosive pattern formed on an incident surface of a lens to mix red light, green light and blue light when the LED of the induction heating cooking device of FIG. 1 has three chips of RGB. FIG. 14 is a view illustrating the length of the incident surface of the convex lens when the LED of the induction heating cooking device of FIG. 1 has one WHITE chip. FIG. 15 illustrates another embodiment of the convex lens of the induction heating cooking device of FIG. 1.

A structure of the convex lens of the induction heating cooking device according to the first embodiment of the present invention will be described with reference to FIGS. 10 to 15.

The convex lens 170 refracts the light vertically emitted upward from the LED 151, changes the travelling direction thereof to be inclined toward the main slit 183 and concentrates the light.

The convex lens 170 may include a hemispherical portion 171 having a hemispherical exterior and a protruding portion 172 protruding to an outside further than the hemispherical portion 171. The hemispherical portion 171 is located in a direction toward the main slit 183, and the protruding portion 172 is located in an opposite direction thereto. In the embodiment, the protruding portion 172 has an approximately hexahedral shape, but a shape of the protruding portion 172 is not limited.

However, the protruding portion 172 is not essential. As illustrated in FIG. 15, a convex lens 170*c* may include only a hemispherical portion 171*c* without the protruding portion. The reason thereof will be described later.

The convex lens 170 has an empty space 173 formed therein. Also, the convex lens 170 may have an accommodation space 174 for accommodating the LED 151. The empty space 173 may have an approximately triangular shape when being seen from a side, and the accommodation space 174 may have an approximately quadrangular shape. The light emitted from the ELD 151 may travel toward an incident surface 175 of the convex lens 170 in the triangular empty space 173.

The protruding portion 172 is to assist a molding of the convex lens 170 and serves to widen a gap G1 between a portion around a triangular vertex 173*a* of the empty space 173 and an outer surface 172*a* of the protruding portion 172 adjacent thereto so that the portion around the triangular vertex 173*a* is evenly filled with a resin upon an injection molding of the convex lens 170. As the gap is widened as described above, the resin may be sufficiently evenly filled during the filling of the resin.

The convex lens 170 may have a first incident surface 175 and a second incident surface 176. The first incident surface 175 refracts the light emitted from the LED 151 toward the main slit 183.

The first incident surface 175 is formed in a flat surface and formed to be inclined at a predetermined angle with respect to the cooking counter 120. Since the first incident surface 175 serves to substantially change the travelling direction of the light emitted vertically upward from the LED 151 toward the main slit 183, the flatness and the angle thereof should be precisely designed. However, since most of the light passed through the second incident surface 176 is blocked by the light source over 180, a shape and an angle of the second incident surface 176 may be freely designed.

The convex lens 170 has an exit surface 177 to which the light refracted through the first incident surface 175 is projected. The exit surface 177 is provided to be directed toward the main slit 183. The exit surface 177 may be a spherical surface or a curved surface having a predetermined curvature. The exit surface 177 is formed to be convex outward and concentrates the light. For example, assuming that a pointing angle of the light emitted from the LED 151 is about 120 degrees, the pointing angle of the light passed through the convex lens 170 may be reduced to about 45 to 65 degrees.

As described above, since the light is concentrated, the going-straight property of the light may be enhanced, and an intensity of the light may be increased even when an output of the LED 151 is not increased. Also, due to a refraction effect of the light, a shape of the flame image F formed on the cooking container may have a three-dimensional effect and thus may be further similar to the actual flame.

A length L1 (FIG. 12) of the incident surface 175 of the convex lens 170 and a size of the empty space 173 may be determined by the number, positions and the pointing angles of chips 152, 153 and 154 of the LED 151.

For example, as illustrated in FIG. 12, when the LED 151 has the three RGB chips 152, 153 and 154, the length L1 of the incident surface 175 should have a sufficient length to cover all of the light emitted from the chip 154 located closest to the incident surface 175 and the light emitted from the chip 152 located farthest away therefrom.

However, as illustrated in FIG. 14, when the LED 151 has one chip 155, it is sufficient for a length L2 of an incident surface 175*b* of a convex lens 170*b* to cover only the light emitted from the one chip 155. That is, the length L2 of the incident surface 175*b* of the convex lens 170*b* and a size of an empty space 173*b* when the LED 151 has the one chip 155 are smaller than the length L1 of the incident surface 175 of the convex lens 170 and the size of the empty space 173 when the LED 151 has the three chips 152, 153 and 154.

Meanwhile, since positions of the chips 152, 153 and 154 are different from each other when the LED 151 has the three RGB chips 152, 153 and 154, a color of the flame image may be changed according to the positions of the chips 152, 153 and 154. In order to prevent this problem, the incident surface 175 of the convex lens 170 according to the embodiment of the present invention may have a corrosive pattern 178 (FIG. 13) for mixing the light emitted from each of the RGB chips 152, 153 and 154 with each other and emitting light having one color. In the embodiment, the corrosive pattern 170 has been formed at the incident surface 175 but may be formed at the exit surface 177.

As illustrated in FIG. 13, the corrosive pattern 178 may have a concavo-convex portion for variously changing a refraction angle of the light. The corrosive pattern 178 may be molded together when the convex lens 170 is molded. That is, the corrosive pattern 178 may be completed by forming the corrosive pattern 178 at a mold for molding the convex lens 170 when a filling of the resin is finished.

FIG. 16 is a schematic view illustrating a structure in which a flame of the induction heating cooking device of FIG. 1 is formed. FIG. 17 is a cross-sectional view illustrating a structure in which the flame of the induction heating cooking device of FIG. 1 is formed. FIG. 18 is a view illustrating the screen fence of the induction heating cooking device of FIG. 1. FIG. 19 is a view illustrating an action of a horizontal hairline of the surface of the cooking container put on the induction heating cooking device of FIG. 1. FIG. 20 is a view illustrating a state in which the virtual flame image is formed on the surface of the cooking container put on the induction heating cooking device of FIG. 1.

A flame forming action in the induction heating cooking device according to the first embodiment of the present invention will be described with reference to FIGS. 16 to 20.

As described above, the induction heating cooking device 100 may include the cooking panel 121 of which at least a part is formed of the transparent material, the light-shielding layer 123 provided at the lower surface of the cooking panel 121 and having the auxiliary slit 124, the induction coil 130 for generating the magnetic field to inductively heat the cooking container C, the light source module 150 having the printed circuit board 156 on which the plurality of light sources 151 are mounted, the optical member 160 having the convex lens 170 for changing the travelling direction of the light emitted from the light source module 150 and concentrating the light, the light source cover 180 having the main slit 183 for passing the light emitted from the light source module 150 to form the flame image F on the cooking container C, and the screen fence 127 provided on the upper surface of the cooking panel 121 to minimize the light of the light source module 150 from being directly exposed to the user and to conceal the light source 151.

When the electric power is applied to the induction coil 130 and the heating of the cooking container C starts, a current is applied to the light source 151 of the light source module 150 and the light is emitted. The travelling direction of the light emitted vertically upward from the light source 151 is changed to be inclined toward the main slit 183 while passing through the convex lens 170 of the optical member 160 and then the light is concentrated. The light passed through the main slit 183 passes through the auxiliary slit 124 and is projected to the surface of the lower end of the cooking container C.

As illustrated in FIG. 19, the light projected to the cooking container C may form the flame image F similar to the actual flame while being scattered and reflected upward and downward by a horizontal hairline H machined on the surface S of the cooking container C.

FIG. 21 is a view schematically illustrating a main configuration of an induction heating cooking device according to a second embodiment of the present invention. FIG. 22 is a view schematically illustrating a main configuration of an induction heating cooking device according to a third embodiment of the present invention. FIG. 23 is a view schematically illustrating a main configuration of an induction heating cooking device according to a fourth embodiment of the present invention.

Induction heating cooking devices according to second to fourth embodiments of the present invention will be described with reference to FIGS. 21 to 23. The same elements as those in the first embodiment will be designated by the same reference numerals, and descriptions thereof will be omitted.

As illustrated in FIG. 21, an induction heating cooking device 200 may include the cooking panel 121 of which at least a part is formed of the transparent material, the light-shielding layer 123 provided at the lower surface of the cooking panel 121 and having the auxiliary slit 124, the induction coil 130 for generating the magnetic field to inductively heat the cooking container C, the light source module 150 having the printed circuit board 156 on which the plurality of light sources 151 are mounted, the optical member 160 having the convex lens 170 for changing the travelling direction of the light emitted from the light source module 150 and concentrating the light, and the light source cover 180 having the main slit 183 for passing the light emitted from the light source module 150 to form the flame image on the cooking container C.

That is, in the induction heating cooking device 200 according to the second embodiment of the present invention, the screen fence 127 provided on the upper surface of the cooking panel 121 to minimize the light emitted from the light source 151 from being directly exposed to the user and thus to conceal the light source 151 is omitted from the elements of the induction heating cooking device 100 according to the first embodiment of the present invention. Since the light of the LED 121 is directly exposed in the form of a thin band to the user through the auxiliary slit 124 due to absence of the screen fence 127, the esthetic sense may be slightly reduced, but a formation of the flame image is not interrupted.

As illustrated in FIG. 22, an induction heating cooking device 300 may include the cooking panel 121 of which at least a part is formed of the transparent material, the light-shielding layer 123 provided at the lower surface of the cooking panel 121 and having the auxiliary slit 124, the induction coil 130 for generating the magnetic field to inductively heat the cooking container C, the light source module 150 having the printed circuit board 156 on which the plurality of light sources 151 are mounted, the light source cover 180 having the main slit 183 for passing the light emitted from the light source module 150 to form the flame image on the cooking container C, and the screen fence 127 provided on the upper surface of the cooking panel 121 to minimize the light of the light source module 150 from being directly exposed to the user and to conceal the light source 151.

That is, in the induction heating cooking device 300 according to the third embodiment of the present invention, the optical member 160 having the convex lens 170 for changing the travelling direction of the light emitted from the light source module 150 and concentrating the light is omitted from the elements of the induction heating cooking device 100 according to the first embodiment of the present invention.

In this embodiment, the light emitted from the light source module 150 may directly pass through the main slit 183 of the light source cover 180 and may form the flame image on the cooking container C. However, a light-concentrating degree is reduced due to absence of the optical member 160 having the convex lens 170 and the brightness of the flame image may be weak, but this problem may be compensated by increasing an output of the LED 151.

In addition, as illustrated in FIG. 23, an induction heating cooking device 400 may include the cooking panel 121 of which at least a part is formed of the transparent material, the light-shielding layer 123 provided at the lower surface of the cooking panel 121 and having the auxiliary slit 124, the induction coil 130 for generating the magnetic field to inductively heat the cooking container C, the light source module 150 having the printed circuit board 156 on which the plurality of light sources 151 are mounted, and the light source cover 183 having the main slit 183 for passing the light emitted from the light source module 150 to form the flame image on the cooking container C.

That is, in the induction heating cooking device 400 according to the fourth embodiment of the present invention, all of the optical member 160 and the screen fence 127 are omitted from the elements of the induction heating cooking device 100 according to the first embodiment of the present invention.

FIG. 24 is a view schematically illustrating a main configuration of an induction heating cooking device according to a fifth embodiment of the present invention. FIG. 25 is a perspective view illustrating a structure of a total reflection lens of the induction heating cooking device of FIG. 24. FIG. 26 is a view illustrating an action of the total reflection lens of the induction heating cooking device of FIG. 24.

An induction heating cooking device according to a fifth embodiment of the present invention will be described with reference to FIGS. 24 to 26. The same elements as those in other embodiments will be designated by the same reference numerals, and descriptions thereof will be omitted.

An induction heating cooking device 500 may include the cooking counter 120 having the auxiliary slit 124 through which the light passes, the induction coil 130 for generating the magnetic field to inductively heat the cooking container C put on the cooking counter 120, the light source module 150 having the printed circuit board 156 on which the plurality of light sources 151 are mounted, an optical member 560 for changing the travelling direction of the light emitted from the light source module 150 and concentrating the light, and the light source cover 180 having the main slit 183 for passing the light emitted from the light source module 150 to form the flame image on the cooking container C.

The optical member 560 may include a total reflection lens 570 and a base portion 561 for supporting the total reflection lens 570 and coupling the optical member 560 to another component. Since the base portion 561 is the same as that in other embodiments, description thereof will be omitted.

The total reflection lens 570 may include a light source accommodating portion 571 having an accommodation space 571*a* in which the light source 151 is accommodated and a lens portion 572 formed at an upper portion of the light source accommodating portion 571 to be gently inclined. The lens portion 572 may be formed to be gently inclined toward the main slit 183.

The total reflection lens 570 may have an incident surface 573 through which the light of the light source 151 is incident, a total reflection surface 574 for totally reflecting the light, and an exit surface 575 through which the light reflected by the total reflection surface 574 is output. The incident surface 573 may be formed at a lower end of the lens portion 572, and the exit surface 575 may be formed at an upper end of the lens portion 572, and the total reflection surface 574 may be formed between the incident surface 573 and the exit surface 575.

The incident surface 573 may be formed to be convex inward, thereby concentrating the light. The incident surface may be a spherical surface or other curved surface.

The total reflection surface 574 may have an appropriate inclined angle so that the light travelled into the total reflection lens 570 through the incident surface 573 is totally reflected. The total reflection is a phenomenon in which the light is not transmitted through a boundary surface but is totally reflected when travelling from a medium having a high refractive index to a medium having a low refractive index and an incident angle is greater than a critical angle.

In the embodiment, when the light travels from the total reflection lens 570 toward an outside, an incident angle θ1 at the total reflection surface 574 of the total reflection lens 570 becomes greater than a critical angle and thus the light is not transmitted but is totally reflected.

Therefore, the light travelled to the total reflection surface 574 with the incident angle θ1 greater than the critical angle may be totally reflected by the total reflection surface 574 and may travel to the exit surface 575 with a reflection angle θ2 which is the same as the incident angle θ1.

The exit surface 575 may be provided to be directed toward the main slit 183, may be formed to be convex outward and thus may concentrate again the output light. The exit surface may be a spherical surface or other curved surface.

FIG. 27 is a view schematically illustrating a main configuration of an induction heating cooking device according to a sixth embodiment of the present invention. FIG. 28 is a view illustrating a structure of a divided lens of the induction heating cooking device of FIG. 27. FIG. 29 is a view illustrating an action of the divided lens of the induction heating cooking device of FIG. 27.

An induction heating cooking device according to a sixth embodiment of the present invention will be described with reference to FIGS. 27 to 29. The same elements as those in other embodiments will be designated by the same reference numerals, and descriptions thereof will be omitted.

An induction heating cooking device 600 may include the cooking counter 120 having the auxiliary slit 124 through which the light passes, the induction coil 130 for generating the magnetic field to inductively heat the cooking container C put on the cooking counter 120, the light source module 150 having the printed circuit board 156 on which the plurality of light sources 151 are mounted, an optical member 660 for changing the travelling direction of the light emitted from the light source module 150 and concentrating the light, and the light source cover 180 having the main slit 183 for passing the light emitted from the light source module 150 to form the flame image on the cooking container C.

The optical member 660 may include a divided lens 670 and a base portion 661 for supporting the divided lens 670 and coupling the optical member 660 to another component. Since the base portion 661 is the same as that in other embodiments, description thereof will be omitted.

The number of divided lenses 670 is provided to correspond to the number of light sources 151. The divided lens 670 may form two beams of light from one light source 151 and thus may form two flame images from the one light source 151.

The divided lens 670 may be vertically symmetrical about a central surface P. The divided lens 670 may have a common incident surface 671 formed at a center of a lower portion of the divided lens 670 and one pair of exit surfaces 672 and 673 provided at left and right sides of the central surface P. The pair of exit surfaces 672 and 673 may be provided to be directed toward the main slit 183.

The light incident through the common incident surface 671 may be branched and may travel to the pair of exit surfaces 672 and 673 while being reflected several times in the divided lens 670. The pair of exit surfaces 672 and 673 may be formed to be convex outward, thereby concentrating the light. The pair of exit surfaces 672 and 673 may be spherical surfaces or other curved surfaces. The light output from the pair of exit surfaces 672 and 673 may travel to be inclined upward toward the main slit 183.

Since two flame images may be formed through the one light source 151 when the divided lens 670 is used, the required number of light sources 151 may be reduced. However, since the brightness of the flame image may be reduced, the brightness of the flame image may be compensated by increasing an output of the LED 151.

Also, unlike the embodiment, the divided lens may be provided to have one common incident surface and three or more exit surfaces, such that three or more beams of light may be output through one light source and thus three or more flame images may be provided.

FIG. 30 is a view schematically illustrating a main configuration of an induction heating cooking device according to a seventh embodiment of the present invention. FIG. 31 is a view illustrating a structure of an overlapped lens of the induction heating cooking device of FIG. 30. FIG. 32 is a view illustrating an action of the overlapped lens of the induction heating cooking device of FIG. 30.

An induction heating cooking device according to a seventh embodiment of the present invention will be described with reference to FIGS. 30 to 32. The same elements as those in other embodiments will be designated by the same reference numerals, and descriptions thereof will be omitted.

An induction heating cooking device 700 may include the cooking counter 120 having the auxiliary slit 124 through which the light passes, the induction coil 130 for generating the magnetic field to inductively heat the cooking container C put on the cooking counter 120, the light source module 150 having the printed circuit board 156 on which the plurality of light sources 151 are mounted, an optical member 760 for changing the travelling direction of the light emitted from the light source module 150 and concentrating the light, and the light source cover 180 having the main slit 183 for passing the light emitted from the light source module 150 to form the flame image on the cooking container C.

The optical member 760 may include an overlapped lens 770 and a base portion 761 for supporting the overlapped lens 770 and coupling the optical member 760 to another component. Since the base portion 761 is the same as that in other embodiments, description thereof will be omitted.

The number of overlapped lenses 770 is provided to correspond to a half of the number of light sources 151. The overlapped lens 770 may form one beam of light from two light sources 151 and thus may form one flame image from the two light sources 151.

The overlapped lens 770 may be vertically symmetrical about a central surface P. The overlapped lens 770 may have one pair of incident surfaces 771 and 772 provided at left and right side lower portions of the central surface P and a common exit surface 773 formed at an upper portion of a center thereof. The common exit surface 773 may be provided to be directed toward the main slit 183. The light output through the common exit surface 773 may travel to be inclined upward toward the main slit 183.

The light incident through the pair of incident surfaces 771 and 772 may be overlapped and may travel to the common exit surface 773 while being reflected several times in the overlapped lens 770. The common exit surface 773 may be formed to be convex outward, thereby concentrating the light. The common exit surface 773 may be a spherical surface or other curved surface.

Since one flame image may be formed through the two light sources 151 when the overlapped lens 770 is used, the brightness of the flame image may be remarkably increased.

Also, unlike the embodiment, the overlapped lens may be provided to have three or more incident surfaces and one common exit surface, such that one beam of light may be output through three or more light sources and thus one flame image may be provided.

FIG. 33 is a view schematically illustrating a main configuration of an induction heating cooking device according to an eighth embodiment of the present invention. FIG. 34 is a view illustrating a structure of a concave mirror of the induction heating cooking device of FIG. 33. FIG. 35 is a view illustrating an action of the concave mirror of the induction heating cooking device of FIG. 33.

An induction heating cooking device according to an eighth embodiment of the present invention will be described with reference to FIGS. 33 to 35. The same elements as those in other embodiments will be designated by the same reference numerals, and descriptions thereof will be omitted.

An induction heating cooking device 800 may include the cooking counter 120 having the auxiliary slit 124 through which the light passes, the induction coil 130 for generating the magnetic field to inductively heat the cooking container C put on the cooking counter 120, the light source module 150 having the printed circuit board 156 on which the plurality of light sources 151 are mounted, an optical member 860 for changing the travelling direction of the light emitted from the light source module 150 and concentrating the light, and the light source cover 180 having the main slit 183 for passing the light emitted from the light source module 150 to form the flame image on the cooking container C.

The optical member 860 may include a concave mirror 870 and a base portion 861 for supporting the concave mirror 870 and coupling the optical member 860 to another component. Since the base portion 861 is the same as that in other embodiments, description thereof will be omitted.

The concave mirror 870 may indude a mirror portion 873 for reflecting the light toward the main slit 183 and a supporting portion 871 provided at a lower portion of the mirror portion 873 to support the mirror portion 831. The mirror portion 831 may be formed to be inclined toward the main slit 183. The mirror portion 831 may be provided to be rotatable about the supporting portion 871, thereby controlling a reflection angle of the mirror portion 831. The supporting portion 871 may have an accommodation space 872 in which the LED 151 is accommodated.

The mirror portion 873 may have a reflection surface 874 for reflecting the light emitted from the LED 151 toward the main slit 183. The reflection surface 874 may be formed to be concave inward, thereby concentrating the light. The reflection surface 874 may be a spherical surface or other curved surface. The light reflected by the reflection surface 874 may travel to be inclined upward toward the main slit 183.

FIG. 36 is a view schematically illustrating a main configuration of an induction heating cooking device according to a ninth embodiment of the present invention. FIG. 37 is a view illustrating a structure of a lighting-guide bar of the induction heating cooking device of FIG. 36. FIG. 37 is a view illustrating a reflection pattern of the lighting-guide bar of the induction heating cooking device of FIG. 36. FIG. 39 is a view illustrating an action of the lighting-guide bar of the induction heating cooking device of FIG. 36.

An induction heating cooking device according to a ninth embodiment of the present invention will be described with reference to FIGS. 36 to 39. The same elements as those in other embodiments will be designated by the same reference numerals, and descriptions thereof will be omitted.

An induction heating cooking device 900 may include the cooking counter 120 having the auxiliary slit 124 through which the light passes, the induction coil 130 for generating the magnetic field to inductively heat the cooking container C put on the cooking counter 120, a light source module 950 having a printed circuit board 956 on which at least one light source 951 is mounted, an optical member 960 for changing the travelling direction of the light emitted from the light source module 950 and concentrating the light, and the light source cover 180 having the main slit 183 for passing the light emitted from the light source module 950 to form the flame image on the cooking container C.

The optical member 960 may be a lighting-guide bar 960.

In the embodiment, the induction heating cooking device 900 has two light source modules 950, and each of the light source modules 950 may include one printed circuit board 956 and one light source 951. The light emitted from the two light source modules 950 passes through the lighting-guide bar 960, and a plurality of beams of light are emitted.

However, the present invention is not limited thereto, and the induction heating cooking device 900 may have one light source module 950 or may have three or more light source modules 950. A plurality of light sources 951 may be mounted on the printed circuit board 956.

The lighting-guide bar 960 may have an approximately arc shape and the light source module 950 may be disposed at each of both ends thereof. One pair of incident surfaces 961 and 962 may be formed at both ends of the lighting-guide bar 960. The printed circuit board 956 of the light source module 950 may be approximately vertically disposed so that the LED 951 mounted thereon is directed toward the incident surfaces 961 and 962 of the lighting-guide bar 960.

However, unlike this, the lighting-guide bar 960 may be provided to have a closed ring shape of 360 degrees.

In the embodiment, the lighting-guide bar 960 has a reflection surface 963 formed to be flat and a pentagonal cross section having a first surface 964, a second surface 965, a third surface 966 and a fourth surface 967. However, the lighting-guide bar 960 may be provided in various shapes such as a triangular shape, a quadrangular shape, a circular shape and other curved surface shape, as long as the reflection surface 963 is formed to be flat, and a shape thereof is not limited.

The reflection surface 963 may be provided to be inclined with respect to the cooking counter 120. A plurality of reflection patterns 964 may be formed at the reflection surface 963 to be spaced apart from each other at predetermined intervals in a lengthwise direction of the lighting-guide bar 960. The reflection patterns 964 may reflect the light toward the main slit 183. Also, the reflection patterns 964 may be provided to concentrate the light.

The number of reflection patterns 964 may be provided to be the same as the number of flame images. That is, the flame images may be formed by the number of reflection patterns 964. Each of the reflection patterns 964 may include a concavo-convex portion and may have various shapes such as a prism shape, a spherical shape and a cylindrical shape.

Due to such a configuration, the light incident through the pair of incident surfaces 961 and 962 provided at both ends of the lighting-guide bar 960 in the lengthwise direction thereof is reflected by the reflection patterns 964 of the reflection surface 963 and then output through other surfaces of the lighting-guide bar, and the output light may travel to be inclined upward toward the main slit 183.

As described above, in the induction heating cooking device according to the embodiment of the present invention, the travelling direction the light emitted from the light source module is changed through various types of optical members 560, 660, 760, 860 and 960 or the light is concentrated therethrough, and thus the flame image similar to the actual flame may be formed.

FIGS. 40 and 41 are enlarged views illustrating an operation unit of the induction heating cooking device of FIG. 1.

The operation unit 14 for receiving an output level of the induction heating cooking device 100 may include an operation knob 14*a* provided to be rotatable. The operation knob 14*a* may be rotated in a clockwise direction C or a counterclockwise direction CC.

An output level mark 14*b* may be provided at a flange of the operation knob 14*a* to display an output level. The output level mark 14*b* may be rotated together with the operation knob 14*a*.

An indication mark 14*c* for indicating the output level selected by the operation knob 14*a* may be formed at the main body of the induction heating cooking device 100. The indication mark 14*c* is fixed to the main body of the induction heating cooking device 100. In the embodiment, the indication mark 14*c* has been provided at an approximately upper side of the operation knob 14*a*. However, a position of the indication mark 14*c* is not limited.

The user may slightly press the operation knob 14*a* in a direction P toward the main body of the induction heating cooking device 100 and then may rotate the operation knob 14*a* when operating the induction heating cooking device 100. Due to such an operating method of the operation knob 14*a*, the induction heating cooking device 100 may further have a feeling like a gas range.

When the user rotates the operation knob 14*a* in the clockwise direction C or the counterclockwise direction CC, the output level mark 14*b* is rotated together with the operation knob 14*a*, and one of a plurality of output levels indicated on the output level mark 14*b*, which faces the indication mark 14*c*, may be input to the induction heating cooking device 10.

For example, when the user rotates the operation knob 14*a* in the counterclockwise direction CC, the output level 1, 2, 3, . . . 9 faces the indication mark 14*c* according to rotation of the operation knob 14*a*, as illustrated in FIG. 41, and the output level 1, 2, 3, . . . 9 may be input to the oven range 1.

In addition, when the user rotates the operation knob 14*a* in the clockwise direction C in an OFF state, a maximum output level may be input to the induction heating cooking device 1.

In other words, when the user rotates the operation knob 14*a* in the counterclockwise direction CC in the OFF state, the output level indicated on the output level mark 14*b* is input in turn, and when the user rotates the operation knob 14*a* in the clockwise direction in the OFF state, the maximum output level may be immediately input.

Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. An induction heating cooking device, comprising:

a cooking counter having a panel of which at least a part is formed of a transparent material, and having a light shielding layer on a surface of the panel, the light shielding layer having an auxiliary slit through which light can pass, the cooking counter configured to have a cooking portion with a cooking container positioned thereon;

an induction coil below the cooking portion of the cooking counter, configured to generate a magnetic field to inductively heat the cooking container positioned on the cooking portion of the cooking counter, the auxiliary slit being located on a portion of the cooking counter outside a periphery of the cooking portion;

at least one light source disposed outside the induction coil to emit light;

an optical member to change a travelling direction of the light emitted from the at least one light source and to concentrate the light; and a cover having a main slit arranged below the auxiliary slit of the light shielding layer, to pass the concentrated light from the optical member through the auxiliary slit to form at least one image on a side of the cooking container based on the cooking container being positioned on the cooking portion of the cooking counter over the induction coil.

2. The cooking device of claim 1, wherein the optical member includes a convex lens.

3. The cooking device of claim 2, wherein an incident surface of the convex lens is formed in a flat surface and also formed to be inclined with respect to the cooking counter.

4. The cooking device of claim 2, wherein an exit surface of the convex lens is formed in a curved surface to be convex outward and also provided to be directed toward the main slit.

5. The cooking device of claim 2, wherein an incident surface of the convex lens has a sufficient length to cover the light emitted from at least one chip of the at least one light source.

6. The cooking device of claim 2, wherein an incident surface of the convex lens has a corrosive pattern for mixing the light emitted from at least one chip of the at least one light source.

7. The cooking device of claim 1, wherein the convex lens has an empty space formed therein in a triangular shape when being seen from a side.

8. The cooking device of claim 1, wherein the optical member includes at least one reflection lens corresponding to the at least one light source.

9. The cooking device of claim 8, wherein a reflection lens among the at least one reflection lens includes a reflection surface not to transmit an approaching light but to reflect at least one light among the at least one light source.

10. The cooking device of claim 9, wherein the at least one light travelled to the reflection surface of the at least one reflection lens is reflected toward an exit surface of the at least one reflection lens.

11. The cooking device of claim 8, wherein an incident surface of the at least one reflection lens is formed in a spherical surface to be convex toward an inside of the at least one reflection lens to concentrate the light.

12. The cooking device of claim 8, wherein an exit surface of the at least one reflection lens is formed in a spherical surface to be convex toward an outside of the at least one reflection lens to concentrate the light and also provided to be directed toward the main slit.

13. The cooking device of claim 1, wherein the optical member includes a divided lens for forming a plurality of beams of light from one light source among the at least one light source.

14. The cooking device of claim 13, wherein the divided lens has one common incident surface and a plurality of exit surfaces.

15. The cooking device of claim 13, wherein the divided lens is vertically symmetrical about a central surface.

16. The cooking device of claim 1, wherein the at least one light source are a plurality of light sources, and the optical member includes an overlapped lens for forming one beam of light from the plurality of light sources.

17. The cooking device of claim 16, wherein the overlapped lens has a plurality of incident surfaces and one common exit surface.

18. The cooking device of claim 16, wherein the divided lens is vertically symmetrical about a central surface.

19. The cooking device of claim 1, wherein the optical member includes a concave mirror.

20. The cooking device of claim 19, wherein the concave mirror includes a concave reflection surface to concentrate the light.

21. The cooking device of claim 1, wherein the optical member includes an arc-shaped lighting-guide bar.

22. The cooking device of claim 21, wherein a plurality of incident surfaces are formed at both ends of the arc-shaped lighting-guide bar.

23. The cooking device of claim 22, wherein the arc-shaped lighting-guide bar includes a reflection surface provided to be inclined with respect to the cooking counter.

24. The cooking device of claim 23, wherein the arc-shaped lighting-guide bar includes a plurality of reflective patterns formed at the reflection surface to be spaced apart from each other in a lengthwise direction of the arc-shaped lighting guide bar to reflect the light incident through the plurality of incident surfaces toward the main slit.

25. The cooking device of claim 24, wherein the at least one image is a plurality of flame images and a number of the plurality of flame images formed on the side of the cooking container corresponds to a number of the plurality of reflective patterns.

* * * * *